US005831586A

United States Patent [19]

Hirai et al.

[11] Patent Number: 5,831,586

[45] Date of Patent: Nov. 3, 1998

[54] METHOD OF DRIVING A PICTURE DISPLAY DEVICE

[75] Inventors: Yoshinori Hirai; Akira Nakazawa; Makoto Nagai; Takeshi Kuwata, all of Yokohama, Japan

[73] Assignee: Asahi Glass Company Ltd., Tokyo, Japan

[21] Appl. No.: 549,761

[22] PCT Filed: Apr. 12, 1995

[86] PCT No.: PCT/JP95/00716

§ 371 Date: Nov. 30, 1995

§ 102(e) Date: Nov. 30, 1995

[87] PCT Pub. No.: WO95/28697

PCT Pub. Date: Oct. 26, 1995

[30] Foreign Application Priority Data

Apr. 13, 1994 [JP] Japan ..... 6-074974
Jun. 13, 1994 [JP] Japan ..... 6-130642

[51] Int. Cl.[6] ..... G09G 3/36

[52] U.S. Cl. ..... 345/94; 345/96; 345/100; 345/98; 345/208

[58] Field of Search ..... 345/87, 94, 95, 345/96, 97, 98, 99, 100, 103, 104, 208, 209, 210, 213

[56] References Cited

U.S. PATENT DOCUMENTS 5,262,881 11/1993 Kuwata et al. .
5,489,919 2/1996 Kuwata et al. .

OTHER PUBLICATIONS

WPAT, AN 92–333371/41, EP–A–507061, Oct. 7, 1992.

*Primary Examiner*—Xiao Wu
*Attorney, Agent, or Firm*—Oblon, Spivak, McClelland, Maier & Neustadt, P.C.

[57] ABSTRACT

A method for forming a selection pulse sequence includes arranging, time-sequentially, selection pulse vectors which are applied to simultaneously selected scanning electrodes by repeating a subsequence which has a time period of 1/n (n is an integer of n≧2) times one frame (a time period in which addressing operations are finished).

11 Claims, 15 Drawing Sheets

FIGURE 7
$$(A) = \begin{pmatrix} -1 & -1 & -1 & -1 & -1 & 1 & -1 & -1 \\ 1 & -1 & 1 & -1 & -1 & -1 & 1 & -1 \\ -1 & 1 & -1 & -1 & -1 & -1 & 1 & 1 \\ 1 & 1 & -1 & -1 & 1 & -1 & -1 & -1 \\ -1 & -1 & 1 & -1 & 1 & -1 & -1 & 1 \\ -1 & 1 & 1 & 1 & -1 & -1 & -1 & -1 \\ 1 & -1 & -1 & 1 & -1 & -1 & -1 & 1 \end{pmatrix}$$
FIGURE 8 (a)
EXAMPLE OF 4 X 4 HADAMARD'S MATRIX
(A)
L = 1 1 1 1 1
L = 2 1 -1 1 -1
L = 3 1 1 -1 -1
L = 4 1 -1 -1 1
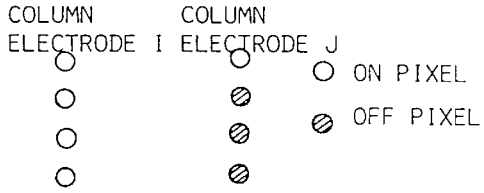
FIGURE 8 (b)
COLUMN ELECTRODE I
(d) (-1 -1 -1 -1)
(v) (-4 0 0 0)
COLUMN ELECTRODE J
(d) (-1 1 1 1)
(v) ( 2 -2 -2 -2)
FIGURE 8 (c)
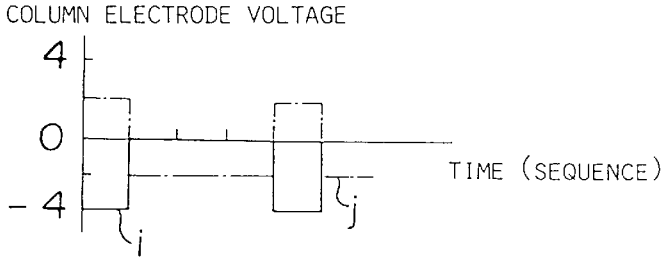

FIGURE 14

| $A_1$ | $A_2$ | $Z_i$ | $R_i$ | $Z_{o.j}$ |
|---|---|---|---|---|
| $\begin{bmatrix} 1 & 1 & -1 & 1 \\ -1 & 1 & 1 & 1 \\ 1 & 1 & 1 & -1 \\ 1 & -1 & 1 & 1 \end{bmatrix}$ | $\begin{bmatrix} 1 & -1 & 1 & 1 \\ -1 & 1 & 1 & 1 \\ 1 & 1 & 1 & -1 \\ 1 & 1 & -1 & 1 \end{bmatrix}$ | (4 1 2 1) | 4 | 4 |
| | | (1 3 1 3) | 4 | 3 |
| | | (3 1 3 1) | 4 | 4 |
| | | (2 1 4 1) | 4 | 3 |
| | | | $R_{max}=4$ | $Z_{max}=4$ |

$$|R_i - R_j| / R_{max} = 0$$
$$Z_{o.j} / Z_{max} = 3/4 \sim 1$$

FIGURE 15 (a)

$$\begin{bmatrix} 1 & -1 & 1 & -1 \\ 1 & 1 & -1 & -1 \\ 1 & -1 & -1 & 1 \end{bmatrix}$$

FIGURE 15 (b)

PATTERNS OF REPEATING POSITIVE OR NEGATIVE SIGN $$\begin{bmatrix} 1 & -1 & 1 & -1 \\ 1 & 1 & -1 & -1 \\ 1 & -1 & -1 & 1 \end{bmatrix} \begin{bmatrix} 1 & -1 & 1 & -1 \\ 1 & 1 & -1 & -1 \\ 1 & -1 & -1 & 1 \end{bmatrix} \begin{bmatrix} 1 & -1 & 1 & -1 \\ 1 & 1 & -1 & -1 \\ 1 & -1 & -1 & 1 \end{bmatrix} \cdots \begin{matrix} (1\ 1\ 1\ 1) \\ (2\ 2) \\ (2\ 2) \end{matrix}$$

FIGURE 16

$$\begin{bmatrix} -1 & -1 & -1 & -1 & -1 & 1 & -1 & -1 \\ 1 & -1 & 1 & -1 & -1 & -1 & 1 & -1 \\ -1 & 1 & -1 & -1 & -1 & -1 & 1 & 1 \\ 1 & -1 & -1 & -1 & 1 & -1 & -1 & 1 \\ -1 & 1 & 1 & -1 & 1 & -1 & -1 & -1 \\ -1 & -1 & 1 & 1 & -1 & -1 & -1 & 1 \\ 1 & 1 & -1 & 1 & -1 & -1 & -1 & -1 \end{bmatrix}$$

WHEN $(x) = (1\ 1\ 1\ 1\ 1\ 1\ 1\ 1)$,
$(y) = (-1\ -1\ -1\ -3\ -3\ -5\ -3\ -1)$

WHEN $(x) = (1\ 1\ 1\ -1\ -1\ 1\ 1\ 1)$,
$(y) = (-1\ -1\ -1\ 1\ -7\ -1\ 1\ -1)$

FIGURE 18 (a)

$$\underset{(A)}{\begin{bmatrix} 1 & 1 & 1 & 1 \\ 1 & -1 & 1 & -1 \\ 1 & 1 & -1 & -1 \\ 1 & -1 & -1 & 1 \end{bmatrix}} \quad \underset{(A')}{\begin{bmatrix} -1 & -1 & -1 & -1 \\ -1 & 1 & -1 & 1 \\ -1 & -1 & 1 & 1 \\ -1 & 1 & 1 & -1 \end{bmatrix}} \quad \underset{(Zi)}{\begin{matrix} (4\ 4) \\ (2\ 1\ 1\ 2\ 1\ 1) \\ (4\ 4) \\ (1\ 2\ 1\ 1\ 2\ 1) \end{matrix}} \quad \begin{matrix} \text{BRIGHT} \\ \text{DARK} \\ \text{BRIGHT} \\ \text{DARK} \end{matrix}$$

FIGURE 18 (b)

$$\underset{(A)}{\begin{bmatrix} 1 & 1 & 1 & 1 \\ 1 & -1 & 1 & -1 \\ 1 & 1 & -1 & -1 \\ 1 & -1 & -1 & 1 \end{bmatrix}} \quad \underset{(A')}{\begin{bmatrix} 1 & -1 & 1 & -1 \\ 1 & 1 & 1 & 1 \\ 1 & -1 & -1 & 1 \\ 1 & 1 & -1 & -1 \end{bmatrix}} \quad \underset{(Zi)}{\begin{matrix} (5\ 1\ 1\ 1) \\ (5\ 1\ 1\ 1) \\ (3\ 2\ 1\ 2) \\ (1\ 2\ 3\ 2) \end{matrix}} \quad \begin{matrix} \text{SLIGHTLY BRIGHT} \\ \text{SLIGHTLY BRIGHT} \\ \\ \\ \end{matrix}$$

FIGURE 17(a)

$$\begin{bmatrix} 1 & -1 & 1 & -1 \\ 1 & 1 & -1 & -1 \\ 1 & -1 & -1 & 1 \end{bmatrix} \begin{bmatrix} -1 & 1 & -1 & 1 \\ -1 & -1 & 1 & 1 \\ -1 & 1 & 1 & -1 \end{bmatrix} \quad \begin{matrix} (2\ 1\ 1\ 2\ 1\ 1) \\ (4\ 4) \\ (1\ 2\ 1\ 1\ 2\ 1) \end{matrix}$$

BRIGHT (A) (A′) (Zi)

FIGURE 17(b)

$$\begin{bmatrix} 1 & -1 & 1 & -1 \\ 1 & 1 & -1 & -1 \\ 1 & -1 & -1 & 1 \end{bmatrix} \begin{bmatrix} 1 & -1 & 1 & -1 \\ 1 & 1 & -1 & -1 \\ 1 & -1 & -1 & 1 \end{bmatrix} \quad \begin{matrix} (1\ 1\ 1\ 1) \\ (2\ 2) \\ (2\ 2) \end{matrix}$$

DARK (A) (=A′) (Zi)

FIGURE 17(c)

$$\begin{bmatrix} -1 & 1 & -1 & 1 \\ 1 & 1 & -1 & -1 \\ 1 & -1 & -1 & 1 \end{bmatrix} \begin{bmatrix} 1 & 1 & -1 & -1 \\ -1 & 1 & -1 & 1 \\ -1 & -1 & -1 & -1 \end{bmatrix} \quad \begin{matrix} (3\ 1\ 1\ 3) \\ (3\ 3\ 1\ 1) \\ (4\ 1\ 2\ 1) \end{matrix}$$

(A) (A′) (Zi)

FIGURE 17(d)

$$\begin{bmatrix} -1 & 1 & -1 & -1 \\ 1 & 1 & -1 & 1 \\ 1 & -1 & -1 & -1 \end{bmatrix} \begin{bmatrix} -1 & 1 & -1 & -1 \\ 1 & 1 & -1 & 1 \\ 1 & -1 & -1 & -1 \end{bmatrix} \quad \begin{matrix} (3\ 1\ 3\ 1) \\ (3\ 1\ 3\ 1) \\ (1\ 3\ 1\ 3) \end{matrix}$$

(A) (A′) (Zi)

FIGURE 19 (a)

| (A) | (A′) | (Zi) | |
|---|---|---|---|
| -1 -1 -1 -1 -1 1 -1 -1 | 1 1 1 1 1 -1 1 1 | (5 1 2 5 1 2) | BRIGHT |
| 1 -1 1 -1 -1 -1 1 -1 | -1 1 -1 1 1 1 -1 1 | (2 1 1 3 1 2 1 1 3 1) | |
| -1 1 -1 -1 -1 -1 1 1 | 1 -1 1 1 1 1 -1 -1 | (3 1 4 3 1 4) | SLIGHTLY BRIGHT |
| 1 -1 -1 -1 1 -1 -1 1 | -1 1 1 1 -1 1 1 -1 | (1 3 1 2 1 1 3 1 2 1) | |
| -1 1 1 -1 1 -1 -1 -1 | 1 -1 -1 1 -1 1 1 1 | (1 2 1 1 3 1 2 1 1 3) | |
| -1 -1 1 1 -1 -1 -1 1 | 1 1 -1 -1 1 1 1 -1 | (3 2 3 3 2 3) | |
| 1 1 -1 1 -1 -1 -1 -1 | -1 -1 1 -1 1 1 1 1 | (6 1 1 6 1 1) | BRIGHT |

FIGURE 19 (b)

| (A) | (A′) | (Zi) |
|---|---|---|
| -1 -1 -1 -1 -1 1 -1 -1 | 1 1 -1 1 -1 1 1 -1 | (6 1 2 2 1 1 1 2) |
| 1 -1 1 -1 -1 -1 1 -1 | 1 -1 -1 -1 1 1 1 1 | (5 1 1 3 1 1 1 3) |
| -1 1 -1 -1 -1 -1 1 1 | -1 1 1 -1 1 1 1 -1 | (2 1 4 2 1 2 1 3) |
| 1 1 -1 -1 1 -1 -1 -1 | -1 -1 1 1 -1 1 1 1 | (5 2 1 5 2 1 1) |
| -1 -1 1 -1 1 -1 -1 1 | 1 1 1 1 1 -1 1 1 | (2 1 1 1 2 6 1 2) |
| -1 1 1 1 -1 -1 -1 -1 | -1 1 -1 1 1 1 -1 1 | (1 3 5 1 1 3 1 1) |
| 1 -1 -1 1 -1 -1 -1 1 | 1 -1 1 1 1 1 -1 -1 | (1 2 1 3 2 1 4 2) |

FIGURE 19 (c)

| (A) | (A′) | (Zi) |
|---|---|---|
| -1 -1 -1 -1 -1 1 -1 -1 | -1 -1 1 -1 1 -1 -1 1 | (5 1 4 1 1 1 2 1) |
| 1 -1 1 -1 -1 -1 1 -1 | -1 1 1 1 -1 -1 -1 -1 | (1 1 1 3 1 2 3 4) |
| -1 1 -1 -1 -1 -1 1 1 | 1 -1 -1 1 -1 -1 -1 1 | (1 1 4 3 2 1 3 1) |
| 1 1 -1 -1 1 -1 -1 -1 | 1 1 -1 -1 1 -1 -1 -1 | (2 2 1 3 2 2 1 3) |
| -1 -1 1 -1 1 -1 -1 1 | -1 -1 -1 -1 -1 1 -1 -1 | (4 1 1 1 2 1 5 1) |
| -1 1 1 1 -1 -1 -1 -1 | 1 -1 1 -1 -1 -1 1 -1 | (2 3 4 1 1 1 3 1) |
| 1 -1 -1 1 -1 -1 -1 1 | -1 1 -1 -1 -1 -1 1 1 | (3 2 1 3 1 1 1 4) |

METHOD OF DRIVING A PICTURE DISPLAY DEVICE

BACKGROUND OF THE INVENTION

Field of the Invention

TECHNICAL FIELD

The present invention relates to a method of driving a liquid crystal display device suitable for a liquid crystal of high speed response.

Particularly, the present invention relates to a method of reducing crosstalk in a method of driving a passive matrix type liquid crystal display device wherein multiplex driving is conducted by a multiple line selection method (a MLS method, reference to U.S. Pat. No. 5262881).

DISCUSSION OF THE BACKGROUND

Control of Frame Response in Conventional Techniques

In this specification, a scanning electrode is referred to as a row electrode and a data electrode is referred to as a column electrode.

In a highly intelligence-oriented age, demands to media for information display are increasing. Liquid crystal displays (LCDs) have advantages of being thin, light weight and having low power consumption as well as good adaptability to semiconductor technology; hence, they will be increasingly used. With the propagation of LCD use, there are demands for a large picture surface, a highly precise picture, and a display having a large capacity. Amongst the several techniques, a STN (super-twisted nematic) method is simpler in manufacturing process and lower in cost than a TFT (thin film transistor) method, and accordingly, it is likely that the STN methods become the main stream for future liquid crystal displays.

In order to obtain a large capacity display with use of the STN method, a successive line multiplexed driving (a-line-at-a time scanning) method has been used. In this method, row electrodes are successively selected one by one while column electrodes are driven in correspondence to a pattern to be displayed. When all the row electrodes are selected, the display of one picture is finished.

In the successive line driving method, however, there is known a problem called a frame response which is caused when the capacity of display is large. In the successive line driving method, pixels are applied with relatively high voltages at the time of selection and relatively low voltages at the time of non-selection. The voltage ratio generally becomes large as the number of row electrodes is large (a high duty driving). Accordingly, a liquid crystal which has been responsible to the effective value of voltages (RMS voltage: root mean square voltage) when the voltage ratio is small, becomes responsive to the waveform of the voltages to be applied. Namely, the frame response is a phenomenon caused when the transmittance at the OFF time is increased due to a large amplitude of selection pulses and the transmittance at the ON time is decreased due to a long time interval of the selection pulses, as a result of which the contrast ratio is decreased.

In order to suppress the occurrence of the frame response, there has been known a method of increasing a frame frequency to thereby shorten the time interval of the selection pulses. However, such method has a serious problem. Namely, when the frame frequency is increased, the frequency spectrum of the waveform of applied voltage becomes high. Accordingly, the high-frequency driving method causes an unevenness of display, that is a lack of display uniformity and increase in power consumption. Thus, there is an upper limit in determination of the frame frequency in order to avoid the formation of selection pulses having a narrow width.

Recently, a new driving method has been proposed to overcome the problem without increasing the frequency spectrum. In U.S. Pat. No. 5262881, for instance, a multiple line selection method (MLS method) is described wherein a plurality of row electrodes (selection electrodes) are simultaneously selected. In this method, a plurality of row electrodes are simultaneously selected, and a display pattern in the direction of columns can be controlled independently, whereby the time interval of selection pulse can be shortened while the width of selection pulses can be kept constant. Namely, a display of high contrast can be obtained while the frame response is controlled.

Further, as another technique of controlling the frame response, there is a method disclosed in European Patent Publication No. 507061. In this method, all electrodes are selected at a time to control the frame response.

Summary of a driving method of simultaneously selecting a plurality of row electrodes In the multiple line selection method disclosed in U.S. Pat. No. 5262881, a series of specified voltage pulses are applied to each of the row electrodes which have been simultaneously selected whereby a column display pattern can be independently controlled. In the driving method of simultaneously selecting a plurality of lines, the voltage pulses are simultaneously applied to a plurality of the row electrodes. Accordingly, it is necessary to apply pulse voltages having different polarities to the row electrodes in order to independently and simultaneously control the display pattern in the column direction. The voltage pulses having different polarities are applied several times to the row electrodes with the result that the effective value of voltages (RMS voltages) corresponding to ON or OFF are applied to each pixel in the whole.

A group of selection pulse voltages applied to the simultaneously selected row electrodes within an addressing time can be expressed by a matrix of L rows and K columns (hereinafter, referred to as a selection matrix (A)). Since a sequence of the selection pulse voltages corresponding to each of the row electrodes can be expressed as a group of vectors which are orthogonal in the addressing period, the matrix including these as row elements is an orthogonal matrix. Namely, row vectors in the matrix are mutually orthogonal. In this case, the number of row electrodes corresponds to the number simultaneously selected, and each row corresponds to each line. For instance, the first line in an L number of simultaneously selected lines corresponds to elements in the first row in the selection matrix (A). Then, selection pulses are applied to the elements in the first column, the elements in the second column in this order. In the selection matrix (A), a numerical value 1 indicates a positive selection pulse and a numerical value −1 indicates a negative selection pulse.

Voltage levels corresponding to column elements in the matrix and a column display pattern are applied to the column electrodes. Namely, a series of column electrode voltages is determined by the display pattern and the matrix by which a series of row electrode voltages is determined.

The sequence of voltage waveforms applied to column electrodes is determined as follows.

FIG. 8*a* is a diagram showing column voltages applied. An example of an Hadamard's matrix of 4 rows and 4 columns as the selection matrix will be described. Supposing that display data on column electrodes i and j are as shown in FIG. 8*a*, a column display pattern can be shown as a vector d in FIG. 8*b*. In this case, a numerical value −1 indicates an ON display on a column element and a numerical value 1 indicates an OFF display. When row electrode voltages are successively applied to row electrodes in the order of the columns in the matrix, the column electrode voltage levels assumes vectors v as shown in FIG. 8*b*, and the waveform of the voltages is as in FIG. 8*c*. In FIG. 8*c*, the ordinate and the abscissa respectively have an arbitrary unit.

In a case of the selection of a part of selection lines, it is preferable to dispersively apply the selection pulse voltages in a display cycle in order to control the frame response of the liquid crystal display element. For instance, the first element of the vector v is first applied to a first group of row electrodes which are simultaneously selected (hereinbelow, referred to as a subgroup). Then, the first element of the vector v is applied to a second group of row electrodes which are simultaneously selected. The same sequence is taken successively.

The sequence of voltage pulses applied to the column electrodes is determined depending on how the voltage pulses are dispersed in a display cycle or which selection matrix (A) is selected for the group of row electrodes which are simultaneously selected.

Although the multiple line selection method is very effective to drive a fast responding liquid crystal display element with a high contrast ratio, there has been found, on the other hand, that a flicker becomes conspicuous. Further, in a conventional display with use of the multiple line selection method, there were found two problems which were closely related to the quality of display. One of the problems is that there is an ununiformity of display between simultaneously selected lines, which causes minute uneven portions in the direction of row electrodes between the lines. The other problem is that when the multiple line selection method was used, an uniformity of display relies on a picture (pattern). Namely, in the conventional MLS technique, the voltage waveform of data applied to column electrodes is determined on the basis of the calculation of the data of picture and a selection matrix A. Accordingly, a crosstalk became conspicuous in some cases of displaying pictures.

SUMMARY OF THE INVENTION

Accordingly, one object of the present invention is to reduce an ununiformity of display such as flicker, crosstalk and so on in a driving method wherein a plurality of lines are simultaneously selected.

In accordance with the present invention, there is provided a method of driving a picture display device having a plurality of row electrodes and a plurality of column electrodes, by selecting simultaneously a plurality of row electrodes, wherein selection pulses are dispersively applied to the selected row electrodes in a time period in which an addressing operations are finished, and a sequence obtained by arranging time-sequentially selection pulse vectors applied to the simultaneously selected row electrodes is formed by repeating a subsequence, as a unit, having a time period of 1/n (an integer of $n \geqq 2$) times of the time period in which the addressing operations are finished.

In a preferred embodiment, each value of $m'=m/p$ and $s'=s/p$ is an integer, and a remainder obtained by dividing m' by s' is of an odd number where s indicates the length of the subsequence in which a series of selection pulses are used as a unit, m indicates the number of groups of the simultaneously selected row electrodes, and p indicates the number of times of using continuously the same kind of selection pulse spectrum.

In a further preferred embodiment, a value of $K \cdot m'$ is a multiple of s where K is the number of the kinds of the selection pulse spectrum.

In another preferred embodiment, a value of $s''=s/q$ is an integer, and a remainder obtained by dividing m by s'' is of an odd number where s indicates the length of the subsequence in which a series of selection pulses are used as a unit, m indicates the number of groups of the simultaneously selected row electrodes, and g indicates the number of times of applying continuously the selection pulse spectrum to a specified group of simultaneously selected row electrodes.

In accordance with the present invention, there is provided a method of driving a picture display device having a plurality of row electrodes and a plurality of column electrodes, by selecting an L number ($L \geqq 3$) of row electrodes simultaneously and by applying to the row electrodes selection signals based on column vectors in an orthogonal selection matrix A having row vectors of L rows and K columns arranged orthogonally, wherein at least tow different kinds of selection matrixes ($A_1, A_2, \ldots, A_x$) are used, and in an orthogonal matrix $(B)=(A_1, A_2, \ldots, A_X)$ of L rows and $(X \cdot Y)$ columns which is formed by continuously arranging the at least two different matrices in the order of using, a relation of $|R_i-R_j|/R_{max} \leqq 0.3$ (i, j=1~L) is substantially satisfied where $R_i$ and $R_j$ indicate respectively the length of row voltage sequence vectors $(Z)_i$, $(Z)_j$ (i and j represent i rows and j rows in the matrix (B) respectively) which have as elements the length of continuing positive or negative signs of row vectors in the matrix (B), and $R_{max}$ indicates the maximum value of $R_i$ (i=1~L).

In a preferred embodiment of the invention described just above, the maximum value $Z_{o,j}$ of the elements of $(Z)_j$ and the maximum value $Z_{max}$ of $Z_{o,j}$ (j=1~L) substantially satisfy a relation of $0.6<Z_{o,j}/Z_{max}<1$ (j=1~L).

BRIEF DESCRIPTION OF DRAWINGS

A more complete appreciation of the invention and many of the attendant advantages thereof will be readily obtained as the same becomes better understood by reference to the following detailed descriptions when considered in connection with the accompanying drawings, wherein:

FIG. 7 is an illustration showing an example of a selection matrix;

FIGS. 8*a* to 8*c* are respectively diagrams and a waveform which explain a method of applying voltages in a multiple line selection method;

FIG. 14 is a diagram for explaining a row selection sequence in the driving method of the present invention;

FIGS. 15*a* and 15*b* are diagrams illustrating the scattering of frequency components in row selection pulses;

FIG. 16 is a diagram showing how the uniformity of display depends on a display pattern;

FIGS. 17*a* to 17*d* are diagrams showing row selection sequences;

FIGS. 18*a* and 18*b* are diagrams showing row selection sequences; and

FIGS. 19*a* to 19*c* are diagrams showing row selection sequences.

DESCRIPTION OF THE PREFERRED EMBODIMENTS

Figure 1:
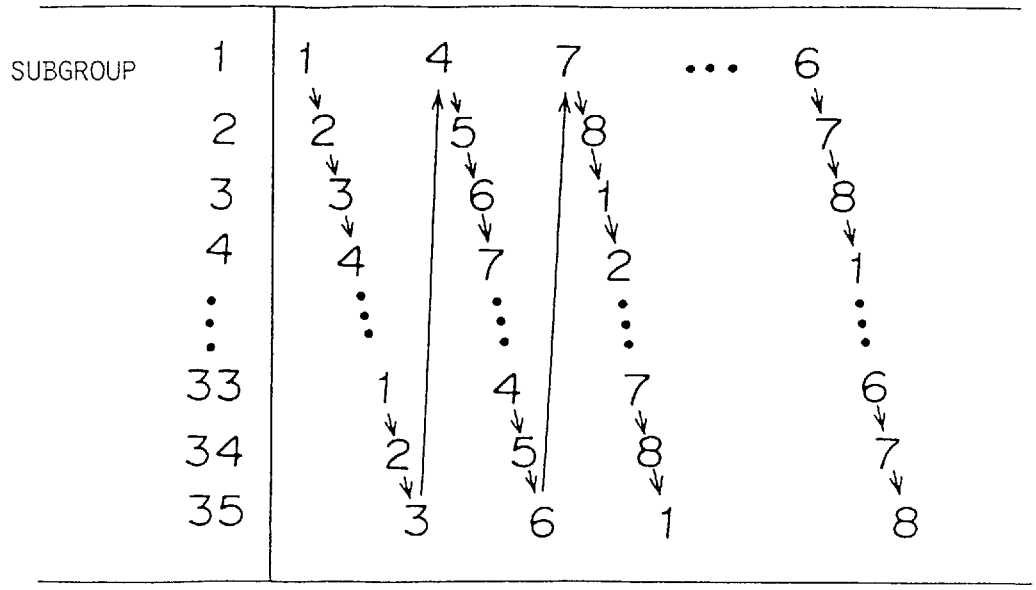
FIGS. 1*a* and 1*b* are respectively diagrams showing examples of a sequence for applying selection pulse spectrum according to the present invention.
Figure 1:
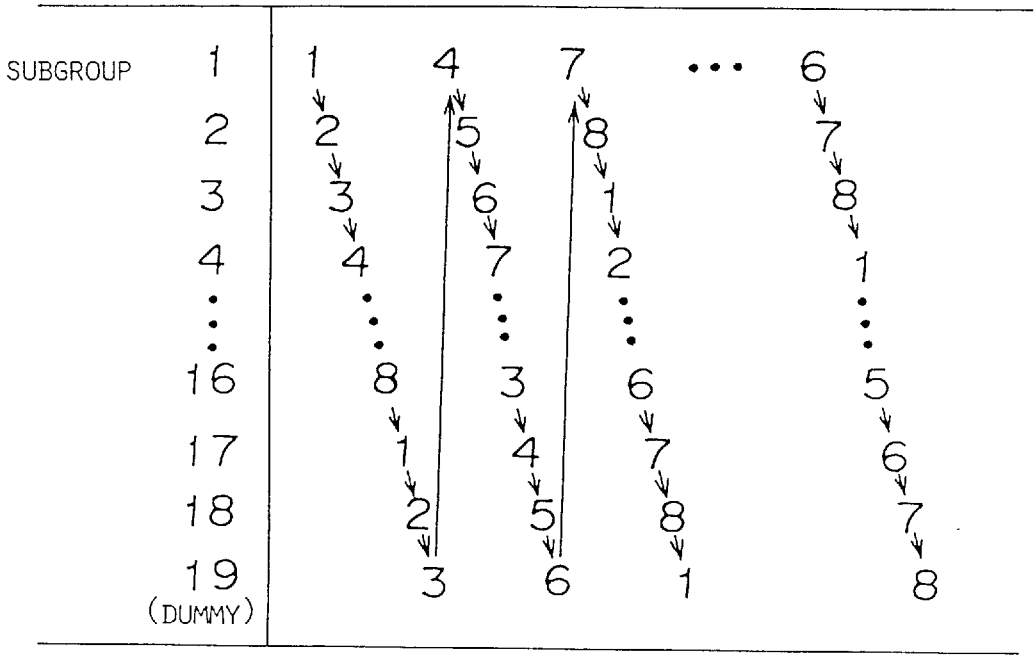

Referring now to the drawings, wherein like reference numerals designate identical or corresponding parts throughout the several views, the present invention will now be explained.

Sequence of column voltage pulses in the method of simultaneously selecting a plurality of row electrodes As described above, in order to reduce the crosstalk, it is very important to study the sequence of voltage pulses actually applied to the column electrodes. Now, description will be made as to the detail of the sequence of the voltage pulses actually applied to the column electrodes in the method of simultaneously selecting a plurality of row electrodes.

In a case of selecting simultaneously a part of row electrodes (partial line selection), there are three ways from the standpoint of determining a time point at which a selection pulse sequence is advanced. In the first way, the selection pulse sequence for row electrodes is advanced one at a time point after a subgroup has been selected and the next subgroup is to be selected, namely, it corresponds to a selection pulse sequence method (1) wherein subgroups constitute units. The second way corresponds to a method (2) wherein the selection pulse sequence is advanced at a time point when all lines have been selected (for all the subgroups). The third way corresponds to an intermediate method (3) of the methods (1) and (2).

Table 1 shows vectors indicating selection pulses for subgroups in a case of using the method (1) or the method (2), wherein $A_1$ and $A_2 \ldots A_M$ represent each column vector in the selection matrix A, and Ns represents the number of subgroups.

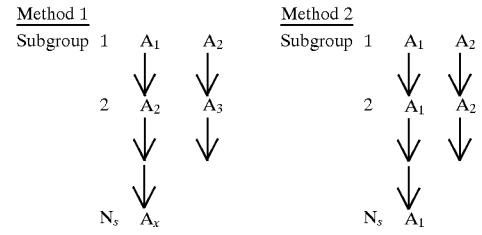

In the sequence of the voltages applied to the column electrodes, when the column electrode voltage levels can be expressed by the vectors (V)=(V1, V2, V3, . . . ) in the same manner as shown in FIG. 4*b*, vectors (v1, V2, V3, . . . , V2, V3, V4, . . . ) are applicable to the method (1) and vectors (V1, V1, . . . V1, V2, V2, . . . , V2, V3, . . . ) are applicable to the method (2). The repeating number of time steps indicates the number of subgroups respectively.

The above-mentioned relation can be described in a general expression comprising a vector and matrix as shown in formula (1):

$$(y)=(x)(S) \qquad \text{Formula(1)}$$

where $(x)=(x_1, x_2, \ldots, x_M)$ $(y)=(y_1, y_2, \ldots, y_N)$ (x): Column electrode display pattern vectors (y): Column electrode voltage sequence vectors (S): Row electrode pulse sequence matrix Vectors (x), vectors (y) and a matrix (S) will be described. Column electrode display pattern vectors $(x)=(x_1, x_2, \ldots, x_M)$ have the same number of elements as the number M of the row electrodes and have display patterns corresponding to the row electrodes on a specified column electrode. In the description, a numeral 1 indicates an OFF state and a numeral −1 indicates an ON state. Column electrode voltages sequence vectors $(y)=(y_1, y_2, \ldots, y_N)$ have the same number of element as the number of pulses N applied in a display cycle, and have as elements voltage levels to specified column electrodes, which are arranged time-sequentially in a display cycle.

The row electrode pulse sequence matrix (S) is a matrix of M rows and N columns, wherein column vectors of row electrode selection voltage levels are arranged, as elements, time-sequentially in one display cycle. The element corresponding to a non-selection row electrode is 0. For instance, the row electrode pulse sequence matrix S in the method (1) includes column vectors $A_i$ of the selection matrix and 0 vectors $Z_e$ and is described as in formula (2).

$$(S)=\begin{bmatrix} A_1 & Z_e & Z_e & \ldots & Z_e & A_2 & Z_e & \ldots & Z_e & A_3 & Z_e & \ldots & Z_e & \ldots & A_K & Z_e & \ldots & Z_e \\ Z_e & A_2 & Z_e & \ldots & Z_e & Z_e & A_3 & \ldots & Z_e & Z_e & A_4 & \ldots & Z_e & \ldots & Z_e & A_1 & \ldots & Z_e \\ Z_e & Z_e & A_3 & \ldots & Z_e & Z_e & Z_e & \ldots & Z_e & Z_e & Z_e & \ldots & Z_e & \ldots & Z_e & Z_e & \ldots & Z_e \\ \cdot & \cdot & \cdot & & \cdot & \cdot & \cdot & & \cdot & \cdot & \cdot & & \cdot & & \cdot & \cdot & & \cdot \\ \cdot & \cdot & \cdot & & \cdot & \cdot & \cdot & & \cdot & \cdot & \cdot & & \cdot & & \cdot & \cdot & & \cdot \\ \cdot & \cdot & \cdot & & \cdot & \cdot & \cdot & & \cdot & \cdot & \cdot & & \cdot & & \cdot & \cdot & & \cdot \\ Z_e & Z_e & Z_e & \ldots & A_p & Z_e & Z_e & \ldots & A_q & Z_e & Z_e & \ldots & A_r & \ldots & Z_e & Z_e & \ldots & A_{p-1} \end{bmatrix} \qquad \text{Formula (2)}$$

In the sequence of the method (2), since the frequency is too low, a flicker may occur. Accordingly, it is sometimes preferable to advance the selection pulse sequence before the selection pulses are applied at least once for each subgroup.

In the following, a case of employing the sequence of the method (1) is described as a typical example. Of course, the same idea is applicable also to the sequence of the method (2) or the method (3). When the sequence of the method (1) is used, the row electrode pulse sequence matrix (S) can be considered as the selection matrix (A) having an arrangement such as (A), . . . (A) except for a case of inverting the polarities and a case of shifting from the last subgroup to the first subgroup. This is because as shown in Table 1 or formula 2, voltages corresponding to $A_1, A_2, \ldots, A_K$ are repeatedly applied to the selected subgroups.

Namely, when the sequence of the method (1) is used, the conditions of the present invention can be satisfied by suitably selecting the selection matrix A (of L rows and K columns). In other words, a suitable matrix can be formed by suitably rearranging the column vectors of an arbitrary matrix having the row vectors which are orthogonal to each other, and using the matrix as the selection matrix. Then, a preferable waveform of the column electrodes can be formed.

Namely, when the sequence of the method (1) is used, the conditions of the present invention can be satisfied by suitably selecting the selection matrix A (of L rows and K columns). In other words, a suitable matrix can be formed by suitably rearranging the column vectors of an arbitrary matrix having the row vectors which are orthogonal to each other, and using the matrix as the selection matrix. Then, a preferable waveform of the column electrodes can be formed.

Use of a New Sequence

In a case of driving a liquid crystal display element with use of a multiple line selection method, a cause of reducing the quality of display is flicker. In particular, when a gray shade display is to be provided by using a frame rate control, the waveform of driving voltages includes a relatively long periodic component. Accordingly, the flicker brings a serial problem.

The present invention is to reduce the occurrence of flicker and to suppress interference by a low frequency component which results by the use of the different kinds of selection matrices described before. The flicker and the low frequency component can be eliminated by forming a selection pulse sequence in such a manner that a subsequence having a time period which is 1/n (an integer of $n \geqq 2$) of a time period in which addressing operations are finished, is repeated as a unit.

However, there is a restriction in order to form the selection pulse sequence wherein a subsequence having a time period of 1/n (an integer of $n \geqq 2$) of 1 frame (a time period for finishing addressing operations) is repeated as a unit. The time period constituted by the above-mentioned repetition units should be a devisor of the time period of 1 frame, with the result that the time period comprising the repeated units is the longest time period in the selection pulse sequence.

Further, when a unit to be repeated in the sequence of selection pulse vectors wherein a selection pulse is used as a unit, is s, the number of groups (subgroups) of simultaneously selected row electrodes is m, the number of selection pulse vectors is K and the number of times of using continuously the same selection pulse vector is p, there should be a specified relation among these values.

However, it is not so easy to satisfy the relation. The degree of freedom to satisfy the relation is relatively small because the number of groups of simultaneously selected rows (row subgroups) is determined under the conditions of the number of the actual scanning lines and the number of simultaneously selected rows which is considered to be effective to control a relaxation phenomenon (frame response) in liquid crystal. On the other hand, the number of selection pulse vectors necessary for addressing is also decisive.

In an embodiment of the present invention, the above-mentioned conditions can be satisfied by driving a liquid crystal display element in which a group (a subgroup) or groups of simultaneously selected row electrodes are imaginarily included. With this measures, the liquid crystal display element can be driven irrespective of the number of scanning lines, the number of simultaneously selected scanning lines and the number of selection pulse vectors used for addressing.

A specific example of this embodiment will be described. First, description will be made as to a case wherein selection pulses are dispersed to the maximum limit in one frame. Namely, a sequence in which a series of selection pulses are applied to a row subgroup, and then, the selection pulses are applied to another row subgroup, is used.

In the driving method in which a plurality of lines are simultaneously selected, it is necessary that (i) selection pulses are defined by column vectors of a matrix (a selection matrix) in which each of row vectors are orthogonally arranged, and (ii) K kinds of selection pulse vectors are applied at the same number of times to all the subgroups in a display cycle. Accordingly, the shortest display cycle means a period in which all kinds of selection pulses are applied once to all the subgroups, within the period the display of a picture is finished. When the display cycle is short, flickers can be prevented.

As a method of satisfying the above-mentioned conditions, it can be assumed that all the selection pulse vectors are successively applied once to all the subgroups. In this method, however, a discontinuous pulse sequence appears in relation to the number m of the subgroups and the number K of the selection pulse vectors. As a result, the sequence has a very long repetition period.

In the following description, the kinds of the selection pulse vectors are represented by the corresponding position of the columns in the selection matrix. Namely, the kinds of the selection pulse vectors are represented by the subscript i of the column vector $A_i$ of the selection matrix in formula 2.

Supposing that 245 row electrodes are driven by applying selection pulses composed of a selection matrix of 7 rows and 8 columns, the number of subgroups is 245/7=35. When selection pulse vectors are applied to each of the subgroups in the order of [1, 2, . . .] in the above-mentioned method, the 35th subgroup is finished with a vector 3. In the second selection time, the sequence starts with a vector 2. Accordingly, there results such discontinuity as [. . . 1, 2, 3, 2, 3, 4 . . .] in the sequence of vectors.

Since such discontinuity is usually produced at the transition in selection from the last subgroup to the first subgroup, there is no periodisity until the application of the selection pulses of 8 times is finished. Accordingly, in this example, a display cycle wherein the selection of 8 times is finished, is repeated.

In a preferred embodiment of the present invention, there is provided a driving sequence to eliminate a long pulse sequence due to the discontinuity of a selection pulse sequence.

In order to satisfy the above-mentioned conditions (i) and (ii), and to eliminate the discontinuity of pulse sequence whereby the length of a display cycle has a short periodisity of pulse sequence, several conditions should be satisfied simultaneously. Namely, when the number of the kinds of selection pulse vectors is K, a unit of repetition pulse sequence where a selection pulse is used as a unit, is s, and the number of groups (subgroups) of simultaneously selected rows is m, a remainder obtained by dividing m by s should be an odd number.

The requirement to have the odd number can be explained as follows. Since row vectors in a selection matrix are arranged with orthogonality in a form of orthogonal matrix, the number of the kinds K of selection pulses (which are usually formed of elements −1 and +1) is generally an even number. Accordingly, in order to select a subgroup periodically and to satisfy the above-mentioned condition (ii), it is necessary that the affixed number of the selection pulse vectors applied to a specified subgroup is changed in a step of an odd member. It is, of course, unnecessary to satisfy the above-mentioned conditions in a case that an element 0 indicative of non-selection is added in part of the selection pulse vectors.

In the following, description will be made in more detail by taking an example that the number of subgroups is 35 or 18 and the kinds of selection pulses are 8. In this case, when the number of simultaneously selected rows is L=7, the number of row electrodes is 245 or 126. FIGS. 2*a* and 2*b* show cases of the dispersion of the selection pulse vectors in a display cycle obtained by using conventionally proposed driving sequences. In FIG. 2*a*, the number of subgroups is 35 and in FIG. 2*b*, the number of subgroups is 18. The letters in the sequences indicate the kinds of the selection pulse vectors. The same premise is also applicable to FIGS. 1 and 3 to 5.

In the conventional method, although it is possible to use dispersively once all selection pulse vectors every 8 times of selecting each of the subgroups, there is discontinuity of sequence in the transition from the last subgroup to the first subgroup, whereby the period of the sequence is equal to one cycle.

On the other hand, FIGS. 1*a* and 1*b* show the sequences according to the present invention. FIG. 1*a* shows a case of the number of subgroups being 35, and FIG. 1*b* shows a case of the number of subgroups being 18.

In the case of 35 subgroups, m=35 and s=8. Then, a remainder of 35÷8 is 3, which satisfies the above-mentioned conditions, and the sequence of the present invention is directly applicable. However, when m=18, a remainder of 18÷8 is 2. Since a value "2" is an even number, the above-mentioned method can not directly be applied. In this case, the above-mentioned relationship can be satisfied by providing a dummy subgroup (the 19th subgroup) as shown in FIG. 1*b*. Then, the above-mentioned sequence can be used. Thus, when the number of subgroups introduced from an actual number of display lines can not satisfy the above-mentioned relation, a dummy subgroup or subgroups can be provided, whereby the driving of the liquid crystal display element is possible keeping the continuity of the sequence.

An extension of the method according to the present invention will be described. In the above-mentioned example, a certain subgroup is selected with a certain selection pulse vector series, and then, the next subgroup is treated by advancing the selection pulse series by one. However, it is possible that the same selection pulse vector series is applied to a plurality of subgroups, and then, the selection pulse series is advanced by one to the plurality of subgroups. FIG. 3*a* and 3*b* show such case. In FIG. 3*a*, there is a case of m=35, and in FIG. 3*b*, m=18.

In FIG. 3*a* wherein m=35, the same selection pulses are applied to a plurality of subgroups p=5 times continuously, and then, the selection pulse series is advanced by one to another plurality of subgroups. In this case, the period of repetition is s =40. Thus, in the case that the selection pulses are continuously applied to a plurality of subgroups, when m'=m/p and s' =s/p, a sequence having a closed selection pulse series in a display cycle and a relatively short period can be formed if a value of m'/s' is of an odd number as described before.

In this example, since m'=7 and s'=8 and a remainder obtained by dividing m' by s' is 7 which is an odd number, the sequence as shown in FIG. 3*a* can be formed.

In the case of m=35, since 35=5×7, either 5 or 7 can be taken as p. In the case of m=18, 18=2×3×3. Since a value m/p should be an odd number, either 2 or 6 is obtainable as p. FIG. 3*b* shows a case of p=2. The period of repetition s' has generally an even number. Accordingly, in order to satisfy the condition that a value of m/p has an odd number, it is necessary for m' to have an odd number in order that a remainder obtained by dividing m' by s' has an odd number.

Even in this case, a dummy subgroup may be provided so as to establish the above-mentioned relationship in the same manner as the example shown in FIG. 1*b*. In a case of m=35, when a dummy subgroup is added, then, m =36=2×2×3×3, whereby p=4 or 12 is possible number of continuation. According to the methods shown in FIGS. 3*a* and 3*b*, the fluctuation of column voltages can be suppressed and driving voltages of low frequency can be obtained, whereby a crosstalk can be effectively reduced.

In the present invention, a frequency component can be easily controlled by effecting the inversion of the polarities of driving signals. In particular, the polarity inversion can be conducted with a period of an integral multiple of a repetition unit. In the present invention, since the period of the repetition unit is short, the degree of freedom of the timing of the polarity inversion is large with the result that the degree of freedom of controlling the frequency component is increased.

Figure 2:
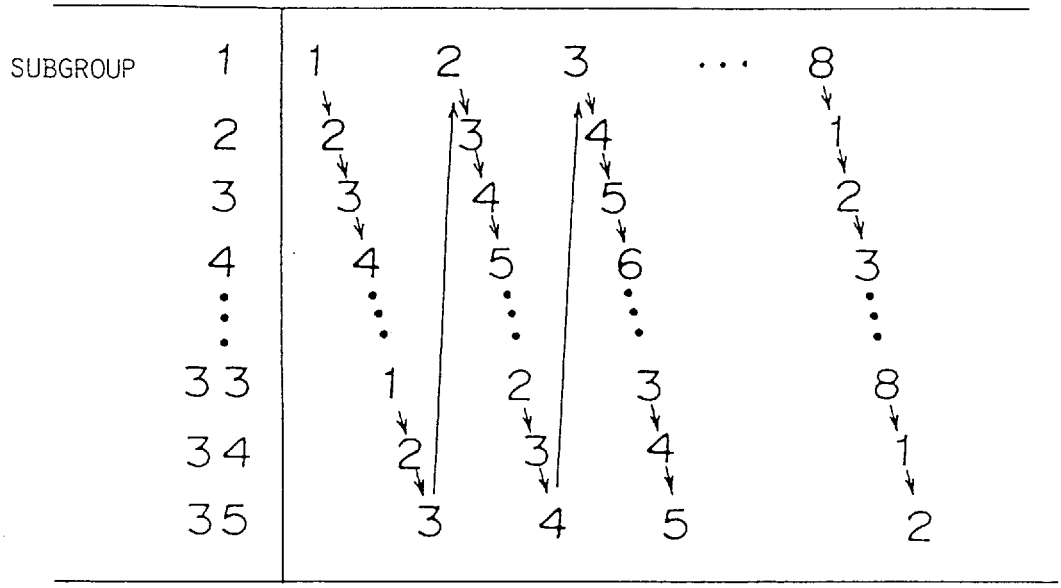
FIGS. 2*a* and 2*b* are respectively diagrams showing conventional sequences for applying selection pulse spectrum.
Figure 2:
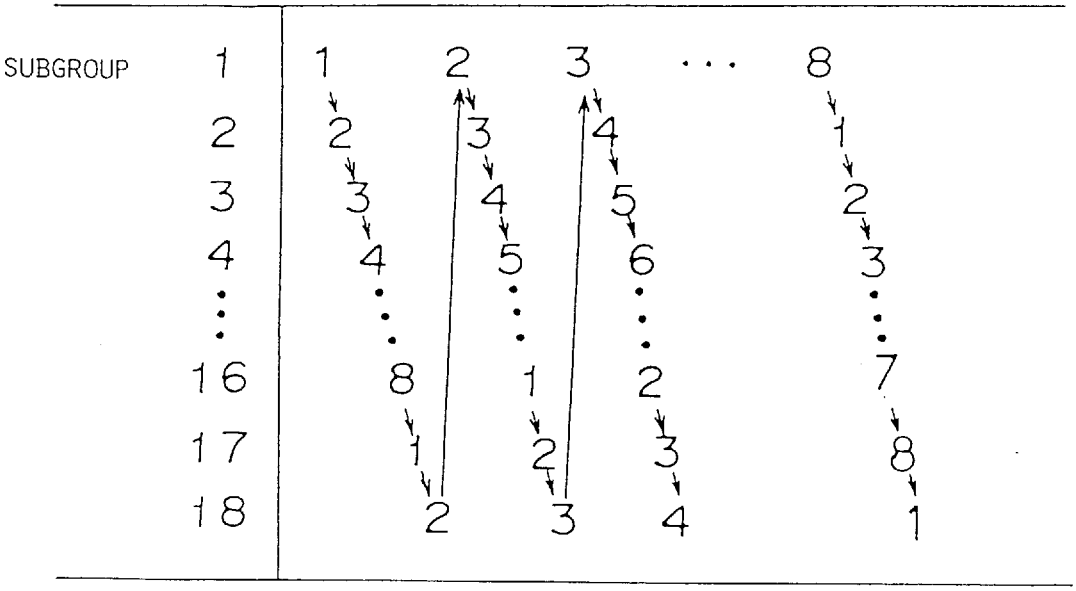
Figure 3:
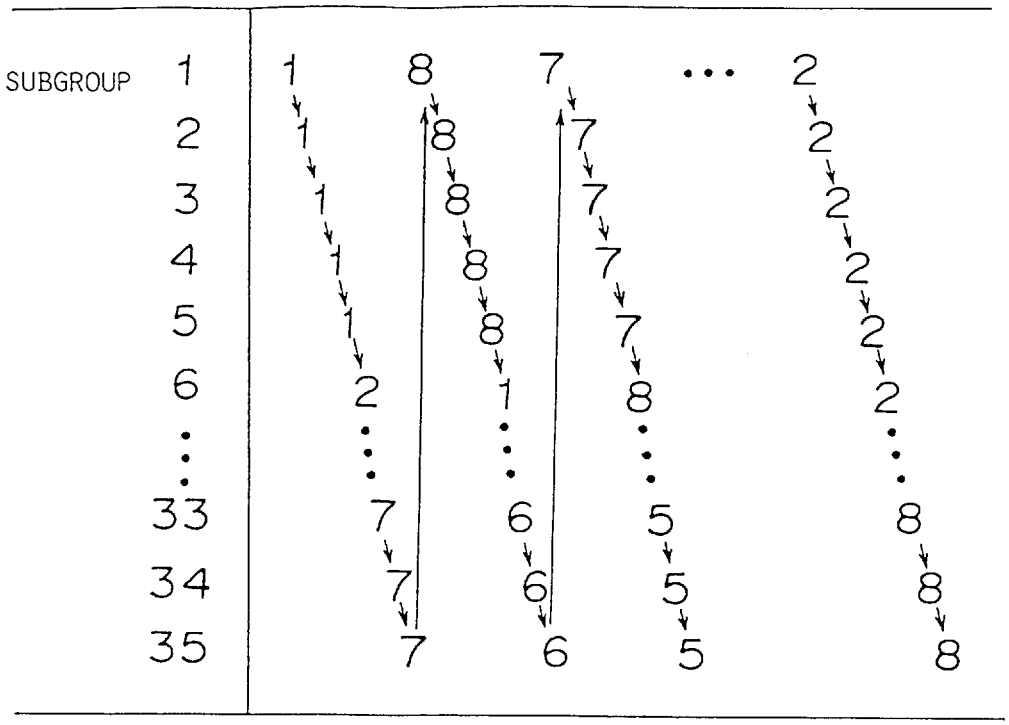
FIGS. 3*a* and 3*b* are respectively diagrams showing other examples of a sequence for applying selection pulse spectrum according to the present invention.
Figure 3:
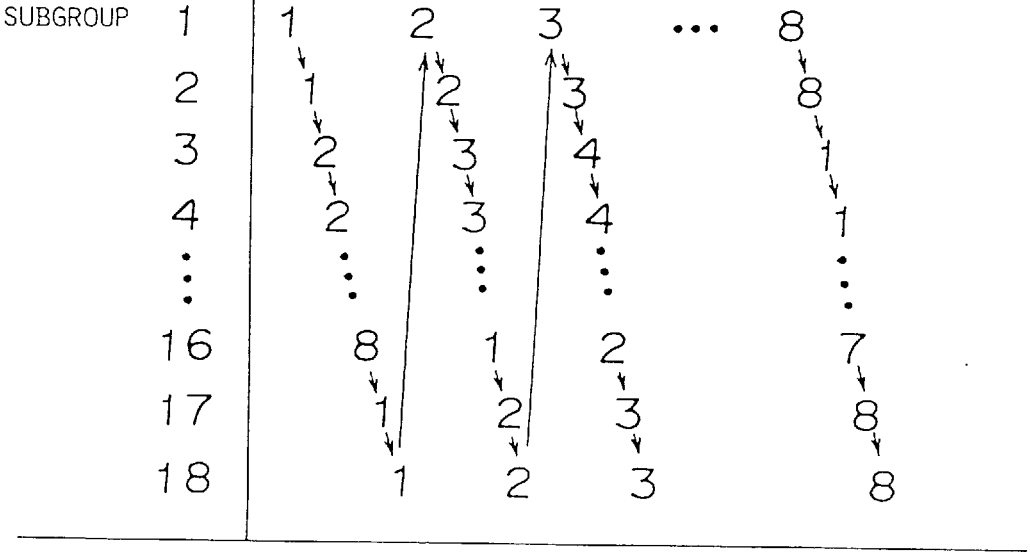

The examples shown in FIGS. 1 and 3 concern that the selection pulses that are completely dispersed in a display cycle. However, the same idea can be applied to a case where the selection pulses are not completely dispersed. Even in this case, the optimum sequence can be formed.

Namely, as another embodiment of the present invention, selection pulses may not be completely dispersed but different kinds of selection pulses may be applied to a specified subgroup successively. It is sometimes unnecessary to disperse the selection pulses when the display element is used for other than high-speed driving.

In the case that different kinds of selection pulses are successively applied to a specified subgroup, when the number of times of selecting successively the same subgroup is g, and the period s is replaced by s"=s/g, the same thought as in FIG. 1 can be applied. Namely, it is necessary that a remainder obtained by dividing m by s/g has an odd number.

Figure 4:
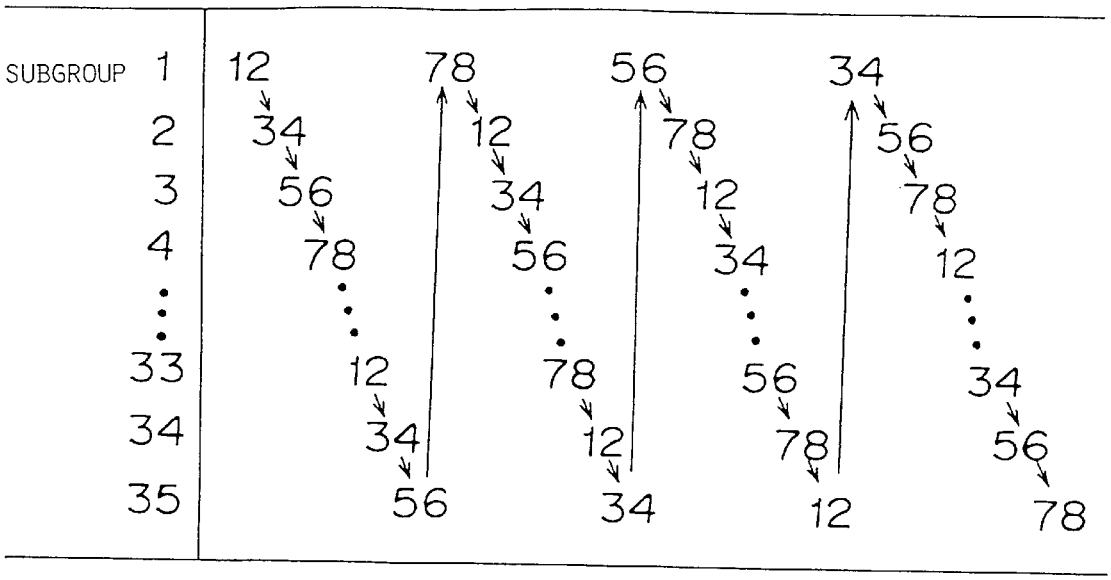
FIGS. 4*a* and 4*b* are respectively diagrams showing other examples of a sequence for applying selection pulse spectrum according to the present invention.
Figure 4:
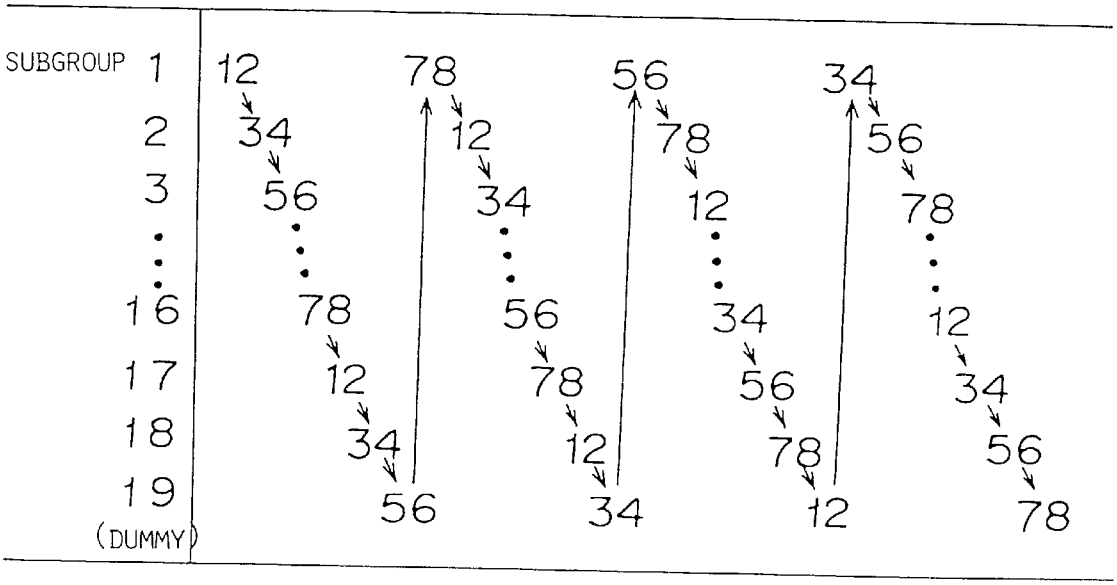

FIG. 4 shows the above-mentioned method. FIG. 4*a* shows a case of m=35, and FIG. 4*b* shows a case of m =18.

In the example of FIG. 4*a* wherein m=35, s=8; g=2, and a remainder obtained by dividing 35 by 4 is 3, which is an odd number. Accordingly, the above-mentioned sequence can be used. In the example of FIG. 4*b* wherein m=18, the above-mentioned relationship can be satisfied by adding a dummy subgroup by the reason as described before.

Figure 5:
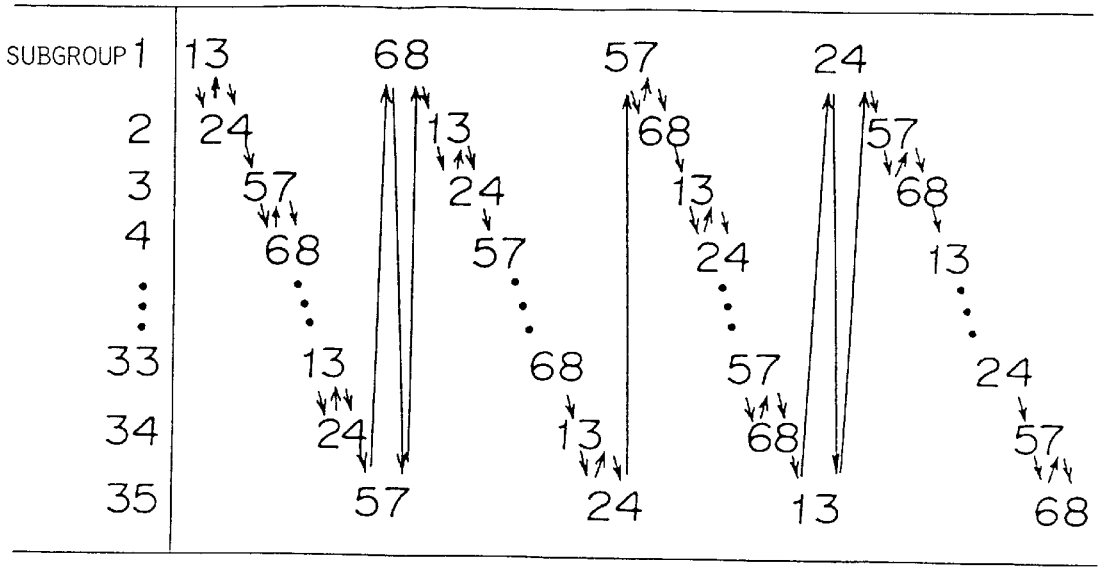
FIG. 5 is a diagram showing another example of a sequence for applying selection pulse spectrum according to the present invention.

When the degree of dispersion of the selection pulses is controlled, it is possible to modify the example shown in FIG. 4*a* to be in a case described in FIG. 5. Thus, the liquid crystal display element can be driven with subsequences for several subgroups (two groups in the case shown in FIG. 5). In this case, it can be considered that a specified subgroup is driven substantially continuously even though the driving is not conducted in a completely continuous state. In the example of FIG. 5, the number of continuation g can be treated as 2. Accordingly, g can be considered to be the number of selection pulses which are not dispersed in the entire cycle in the selection of the same subgroup.

In the above-mentioned examples, the pulse sequence has a period s=8 (1, 2, . . . , 8) wherein the sequence ends 8. Accordingly, occurrence of flicker due to a long period of pulses or the synchronization with other frequency components can be suppressed.

Figure 6:
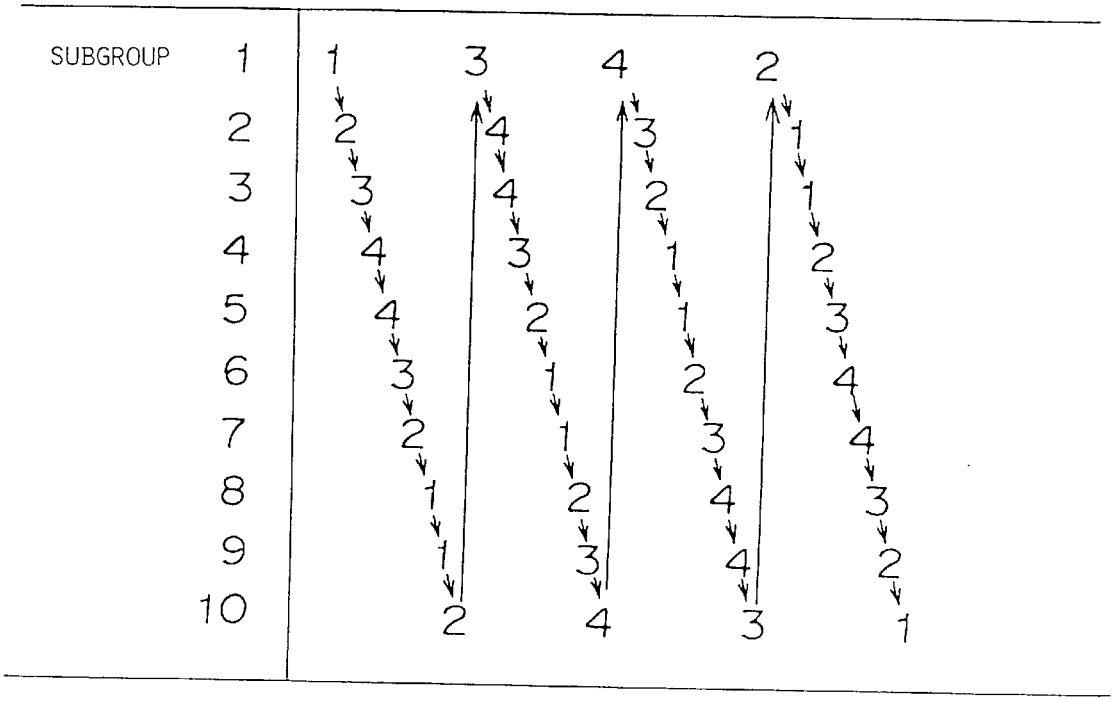
FIG. 6 is a diagram showing another example of a sequence for applying selection pulse spectrum according to the present invention.

Further, as other measures to prevent the formation of a long period of pulses, it is possible to use additionally the inversion of the selection pulse sequence. For instance, the sequence as shown in FIG. 6 can be used when a selection matrix of 4×4 is used where the number of subgroups is 10.

Reduction of an Uneven Display

The inventors of this application have studied the occurrence of an uneven display which is caused by using a multiple line selection method. As a result, they have obtained new findings as described below and have found that the uneven display can be greatly reduced when specified conditions are satisfied.

A first finding is as follows. Namely, the inventors have found fluctuation of frequency components on scanned lines in driving the liquid crystal display element by selecting simultaneously a plurality of lines. In a case of simultaneously selecting an L number of row electrodes, a display pattern arranged in the direction of columns has to be simultaneously and independently controlled. For this purpose, it is necessary to apply pulse voltages having different polarities to the row electrodes. It is naturally derived from the fact that the selection matrix (A) has orthogonality of row vectors. The before-mentioned Hadamard's matrix is a typical example. Accordingly, each of the lines is usually driven with waveforms having different frequency components. The feature of the multiple line selection method is different from that of a successive line driving method. Namely, in the successive line driving method, the row electrodes on the same line are applied with the waveforms having the same frequency components. However, in the multiple line selection method, the frequency components of the waveforms applied to a row electrode are different from the others applied to other row electrodes simultaneously selected. Therefore, when the multiple line selection method is used, a minute uneven display is produced between the lines.

A concrete example of the fluctuation of the frequency components in the driving waveforms on the row electrode is explained with reference to a selection matrix of 3 rows and 4 columns. The elements corresponding to each row of the matrix are successively applied as selection pulses to each of the row electrodes. When the series of pulses as shown in FIG. 15*a* is repeated, each of the row electrodes is applied with different repetition patterns of positive and negative signs of the selection pulses. In other words, with respect to the inversion of the polarities of the selection pulses, the different frequencies are applied to the lines. In FIG. 15*a*, the negative and positive signs of the selection pulses are changed alternately on the line corresponding to the first row. However, in the second and third rows, the signs are changed in every two times. Therefore, the frequency of the selection pulses in the first row is twice as high as that of the second row or the third row. Accordingly, the driving waveform for the second or the third row contains a low frequency component rather than that of the first row (see FIG. 15*b*).

Generally, the magnitude of a distortion of waveform and the threshold characteristics of liquid crystal rely on the frequency of the driving waveforms. Accordingly, the selection pulses for the first line 1 shows higher threshold characteristics than the second or third line. Accordingly, when a negative display (black in an OFF state and white in an ON state) is to be displayed, it looks dark in comparison with the other lines.

A second finding by the inventors is as follows. Namely, in the multiple line selection method, the variation of column electrode voltages in a pulse form strongly affects the variation of the effective value of the waveforms of row electrode voltages. This is also a different feature from the successive line driving method, which is likely that the number of levels of the column electrode voltages in the multiple line selection method is large in comparison with the successive line driving method. Namely, in the successive line driving method, a large distortion of waveforms takes place mainly at the polarity inversion. However, in the multiple line selection system, it also takes place when the variation of the column electrode voltages in a pulse form is large. Accordingly, in the multiple line selection method, there is frequently a variation of the column electrode voltages depending on a kind of selection matrix used. When the variation takes place, strong crosstalks are apt to occur.

More detailed description will be made as to the cause by the variation of the column electrode voltages. The waveform of voltages to be applied to liquid crystal is determined by a row voltage waveform and a column voltage waveform. The column voltage waveform depends on a display pattern of the corresponding columns. Accordingly, there are both cases: a large variation of column electrode voltages and a small variation of column electrode voltages. FIG. 16 shows a selection matrix which can suppress the variation of column electrode voltages in a case where the data of picture image on a certain column are in entirely OFF or entirely ON. In this matrix, the width of the maximum variation $\Delta y$ of column voltage sequence in response to (x)=(1, 1, 1, . . . , 1) is 2, and the variation of the column electrode voltages is relatively small. However, with respect to a unique pattern, for instance, (x)=(1, 1, 1, −1, −1, 1, 1, 1), $\Delta y$ is 8, and a large variation of column electrode voltages is produced.

The main purposes of the present invention is to reduce an uneven display between simultaneously selected lines, which is inherently caused in the MLS method and the picture pattern dependence in obtaining an uniform display. If these purposes can be achieved, a uniform display of picture image superior to that by any conventional STN driving method can be obtained.

In the present invention, two or more kinds of selection matrices are alternately and repeatedly used so that both the uneven display between the simultaneously selected lines and the picture image pattern dependence can be improved simultaneously. Specifically, a preferred method is that a series of selection voltages given by S and a series of selection voltages given by S' are repeatedly applied, i.e., (S→S', S→S') is used. Of course, the matrices used are not limited to two kinds, but three or more kinds of matrices may be applied repeatedly. The series of selection voltages given by S' may be such one that a certain row or rows are replaced in S, or that a column or columns are replaced in S. Or it may be of another series of function. In this case, there arises no problem that the display cycle is elongated because the effective value of voltage for each pixel is determined by a time sequence (cycle) in the matrix. Thus, uniformity of each line can be increased by using different kinds of matrices alternately, whereby a picture image of high uniformity can be provided.

Further, by using repeatedly and alternately two or more kinds of selection matrices, a change of uniformity of display due to the display pattern used can be controlled. The reason is as follows. In a selection matrix, there is a display pattern which increases a change of voltage in a voltage sequence on the column electrodes. However, when two or more kinds of different selection matrices are used, a damage of the uniformity of display with respect to a specified display pattern can be eliminated. Namely, a uniform display with little display pattern dependence can be provided. Accordingly, the method that a plurality of different selection matrices are used alternately to determine the row voltage sequence is very desirable from the standpoint of the uniformity of display between the lines and the uniformity of display between the display patterns.

Further, the present invention features providing the uniformity of frequency of the row voltage sequence itself. Namely, in each of the row vectors in the selection matrix, a continuing number of positive signs (1) or negative signs (−1) (a series of signs) is made uniform on respective rows.

In the present invention, two standards for evaluation are used with respect to the scattering of the frequency of row electrode sequence. In a case that two or more different selection matrices ($A_1, A_2, \ldots, A_x$) are used, an orthogonal matrix (B)=($A_1, A_2, \ldots, A_x$) of L rows and (K·X) columns can be formed by successively arranging the two or more different selection matrices in the order of use. In this case, a formula $|R_i-R_j|/R_{max}$ is given as one of the standards wherein $R_i$ and $R_j$ indicate respectively the length of row voltage sequence vectors $(Z)_i$, $(Z)_j$ (i and j represent i rows and j rows in the matrix (B) respectively) which have as elements the length of continuing positive or negative elements of two row vectors (i,j) in the matrix (B) and $R_{max}$ indicates the maximum value of $R_i$ (i=1~L). The other standard is given by a formula $Z_{o,j}/Z_{max}$ where $Z_{o,j}$ is the maximum value of the elements of $(Z)_j$ and $Z_{max}$ indicates the maximum value of $Z_{o,j}$ (j=1~L).

These standards will be described in more detail. First, the matrices and the sequence are determined in consideration of the following. When a plurality of different matrices are used successively, the period of time is deemed as a cycle, and continuing positive or negative signs of selection pulses for each of the rows (lines) are indicated by the number of pulses. For instance, a series of repetition of (++−−−+++−+) can be expressed as (3331). The vectors formed by successively arranging the continuing number of the signs of selection pulses are called row voltage sequence vectors (Z). In this case, since a sign (+) at the last and a sign (+) at the first are considered to be continuous, the number of pulses is 3.

The first standard $|R_i-R_j|/R_{max}$ can be considered as a standard indicating the degree of uniformity of average frequency of row voltage waveforms. This is an index indicating whether the number of elements of the row electrode sequence vectors (Z) is substantially the same on each of the lines, namely, whether the number of times of the change of the positive and negative signs of the selection pulses is substantially the same for each of the lines.

In the present invention, the number of times $R_i$ of the change of the signs of selection pulses on simultaneously selected lines (=L) in a cycle (a display cycle × the number of kinds of selection matrices each having L rows and K columns), i.e. the number of elements of row voltage sequence vectors should satisfy the condition described in the following formula.

$$|R_i-R_j|R_{max} \leqq 0.3(i,\ j=1\sim L) \tag{1}$$

More preferably, it should satisfy the condition described in the following formula.

$$|R_i-R_j|/R_{max} \leqq 0.2 \tag{1'}$$

When these conditions are satisfied, an uneven display between the lines can be reduced since the frequency components of selection pulses on each of the rows are substantially the same.

The second standard "$Z_{o,j}/Z_{max}$" is an index indicating whether the lowest frequency of selection pulses on each of the rows is substantially the same, i.e., whether there is a large fluctuation in the magnitude of the elements of (Z). In particular, the inclusion of an extremely low frequency component is not desirable.

In the present invention, when the maximum value of the elements of the sequence vectors (Z) on a J row is $Z_{o,j}$, it should satisfy the condition of the following formula with respect to the maximum value $Z_{max}$ of the vectors:

$$0.6 \leqq Z_{o,j}/Z_{max} \leqq 1 \tag{2}$$

More preferably, the condition of the following formula should be satisfied:

$$0.7 \leqq Z_{o,j}/Z_{max} \leqq 1 \tag{2'}$$

Under these conditions, an uneven display between the lines can be reduced since the lowest frequency of selection pulses on each of the rows is substantially the same.

Thus, the above-mentioned formulas provide the conditions concerning the average frequency (the dispersion of frequency) and the lowest frequency of the waveforms of row voltages. These can be used depending on a degree of uniformity required. However, it is most desirable to satisfy both the conditions when a high uniformity is required.

The case of satisfying both the standards will be described with reference to FIG. 14. In a case of using alternately the selection matrices A1 and $A_2$ shown in FIG. 14, there are four kinds vectors $(Z)_i$ on four rows. Since the length of the vectors are all 4, $R_i$ are all 4 irrespective of i, and hence, $R_{max}$ is 4. On the other hand, $Z_{o,j}$ as the greatest value of the elements of vectors (Z)i are respectively, 4, 3, 4, 3, hence, $Z_{max}$ is 4. Accordingly, in the sequence shown in FIG. 14, $|R_1-R_j|/R_{max}=0$. Since $Z_{o,j}/Z_{max}=¾$ or 1, they satisfy not only the conditions (1), (2) but also (1'), (2').

As a known selection matrix, there is a pseudorandom matrix wherein frequency components between lines are uniform. In the pseudorandom matrix, an extremely long sequence is required as the number L of simultaneously selected rows is increased since the number K of selection pulses in a display cycle to the number L becomes $L^{2-1}$. An elongated time period of display cycle is not desirable since there causes an uneven display due to an uneven frequency of the liquid crystal characteristics and flicker.

Although the pseudorandom matrix has many problems, it has an advantage that the frequency component on each selected row is substantially the same. Namely, the pseudorandom matrix is effective to eliminate the difference between lines and provides a uniform display between lines. The inventors have studied the driving method to overcome the above-mentioned problems while the advantage of using the pseudorandom matrix is taken. As a result, they have found an effective driving method in the viewpoints of the orthogonality of row vectors, the length of display cycle and the uniformity between lines.

According to a preferred embodiment of the present invention, there is provided the following formula to evaluate the matrix (S) as to whether the optimum waveform of column voltages from the viewpoint of the width of the variation of the maximum voltage on the time axis (in the order of applying to the sequence):

$$\Delta y_i = |y_i - y_{i-1}|$$

(where i=1~N and $y_o = y_N$.)

Although it is desirable to control the value $\Delta y_i$ to be a specified value or lower in all the display patterns, it is practically difficult since the value $\Delta y_i$ depends on the column electrode display pattern vectors (x). For instance, the value $\Delta y$ is different between a state of entirely ON and a state of a checkered pattern.

In a preferred embodiment of the present invention, (x)=(1, 1, . . . , 1) are selected as the column electrode display pattern vectors (x) which are used as standard. In the study by the inventors, a crosstalk is generally conspicuous in a state of nearly entirely ON or entirely OFF (e.g., a pattern in which there is a block or a line on a uniformly flat pattern). If the crosstalk is suppressed in such state, the quality of display can be remarkably improved over the entirety of a display.

Generally, when a condition of $\Delta y_i \leqq 0.7 \cdot L$ is provided, the difference of the variation of the maximum voltage can be suppressed to a practically applicable extent. $\Delta y_i \leqq 0.5 \cdot L$ is in particular preferable. When the conditions by the above-mentioned formulas can be satisfied, the frequency components can be substantially the same on each line; the display pattern dependence characteristic can be reduced, and the crosstalk can be suppressed while the display cycle is not elongated.

In a further preferred embodiment of the present invention, an uneven display can be reduced by inverting the polarity of the applied voltages at an appropriate timing. Namely, by inverting the polarities at an appropriate period, a d.c. component can be removed even when any type of orthogonal matrix is used as the selection matrix. Further, the frequency band region in which there is the center of the driving waveform can be controlled by adjusting the period of polarity inversion. When the frequency band region is too low, an uneven display or a flicker may result depending on a display pattern. However, such disadvantages can be removed by the inversion of the polarities. In this respect, it is very effective to invert the polarities at the time when the driving frequency is relatively low.

It is desirable to invert the polarities at the time point that the column voltage sequence is in a level near 0 because the variation of the effective value due to the distortion of the waveform which results by the polarity inversion can be minimized. Specifically, it is preferable that the column electrode voltage levels $y_{j-1}$ and $y_j$ before and after the time of the polarity inversion with respect to the number L of simultaneously selected rows satisfies the following relations:

$$|y_{j-1}| \leqq 0.5 \cdot L \text{ and } |y_j| \leqq 0.5 \cdot L$$

where j−1 and j are respectively subscripts indicating a time just before and just after the polarity inversion.

More preferably, the above-mentioned relations can be expressed as follows:

$$|y_{j-1}| \leqq 0.3 \cdot L \text{ and } |y_j| \leqq 0.3 \cdot L$$

where j−1 and j are respectively subscripts indicating a time just before and just after the polarity inversion.

When the above column electrode voltage levels satisfy the conditions, influence of the variation of the effective value of voltage at the time of polarity inversion is minimized.

Further, it is desirable that the difference of the column voltage levels before and after the polarity inversion satisfies a relation $|y_{j-1} - y_j| < 0.7 \cdot L$, it should simultaneously satisfy the above-mentioned relation and $|y_{j-1} - y_j| \leqq 0.5 \cdot L$. Thus, the distortion of the waveform of the column voltages at the time of the polarity inversion and the distortion of the column voltages at the time of the variation of the column voltage can be reduced to thereby contribute the elimination of the uneven display. Further, when the rows and columns are suitably selected; the sequence is suitably selected and the polarity inversion is suitably conducted, the problems of the crosstalk, the uneven display between the lines and the pattern dependence can be simultaneously improved, and a uniform display can be obtained.

Embodiment of a Circuit to Practice the Present Invention

The driving method of the present invention can be realized by using a circuit, as a base, described in U.S. Pat. No. 5262881.

Figure 9:
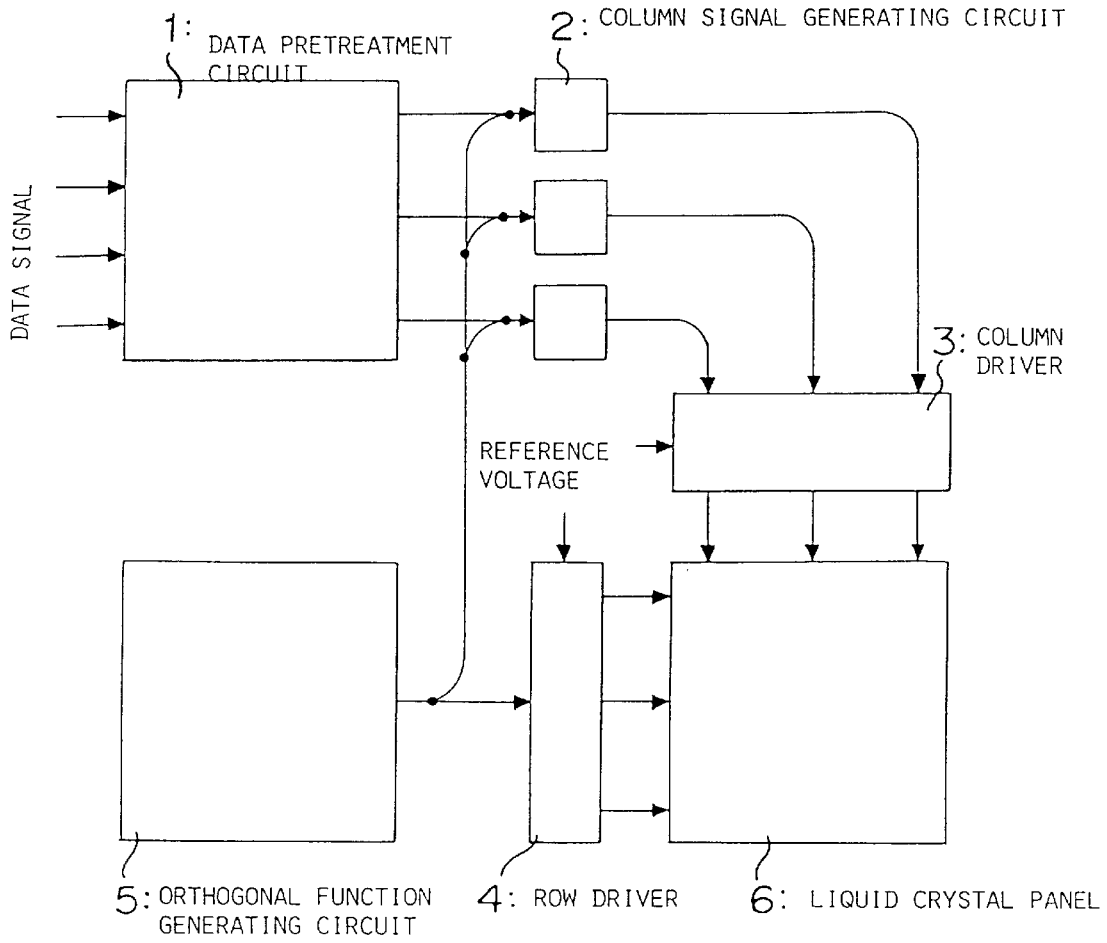
FIG. 9 is a block diagram showing an embodiment of the construction of a circuit for practicing the present invention.

At first, description will be made as to an embodiment of the construction of a circuit generally usable. FIG. 9 is a block diagram of a circuit for effecting a display of 16 gray shades for R, G and B respectively. Signals of 16 gray shades are transformed into 4 bit signals from MSB to LSB, and the data signals are inputted to a data pretreatment circuit 1 which is to produce data signals with a format suitable for forming column signals and outputs the data signals to a column signal generating circuit 2 at a suitable timing. The column signal generating circuit 2 receives the data signals from the data pretreatment circuit 1 and orthogonal functional signals outputted from an orthogonal function generating circuit 5.

The column signal generating circuit 2 performs predetermined operations with use of the above-described signals to form column signals, and outputs the signals to a column driver 3. The column driver 3 produces column electrode voltages to be applied to the column electrodes of a liquid crystal panel 6 with use of a predetermined reference voltage, and outputs the column electrode voltages to the liquid crystal panel 6. On the other hand, the row electrodes of the liquid crystal panel 6 are applied with row electrode voltages which are obtained by converting the orthogonal function signals outputted from the orthogonal function generating circuit 5 in a row driver 4. These circuits may be provided with a timing circuit so that they are operated at a predetermined timing.

The orthogonal function used in the present invention is produced by the orthogonal function generating circuit 5. The orthogonal function generating circuit 5 can perform operations every time the orthogonal function signals are produced. However, it is preferable from the viewpoint of simplicity that the orthogonal unction signals to be used are previously stored in a ROM, and the signals are read out at a suitable timing. Namely, pulses for controlling the timing of the application of voltages to the liquid crystal panel 6 are counted, and the orthogonal function signals in the ROM are successively read out by using the counted value as an addressing signals.

Figure 10:
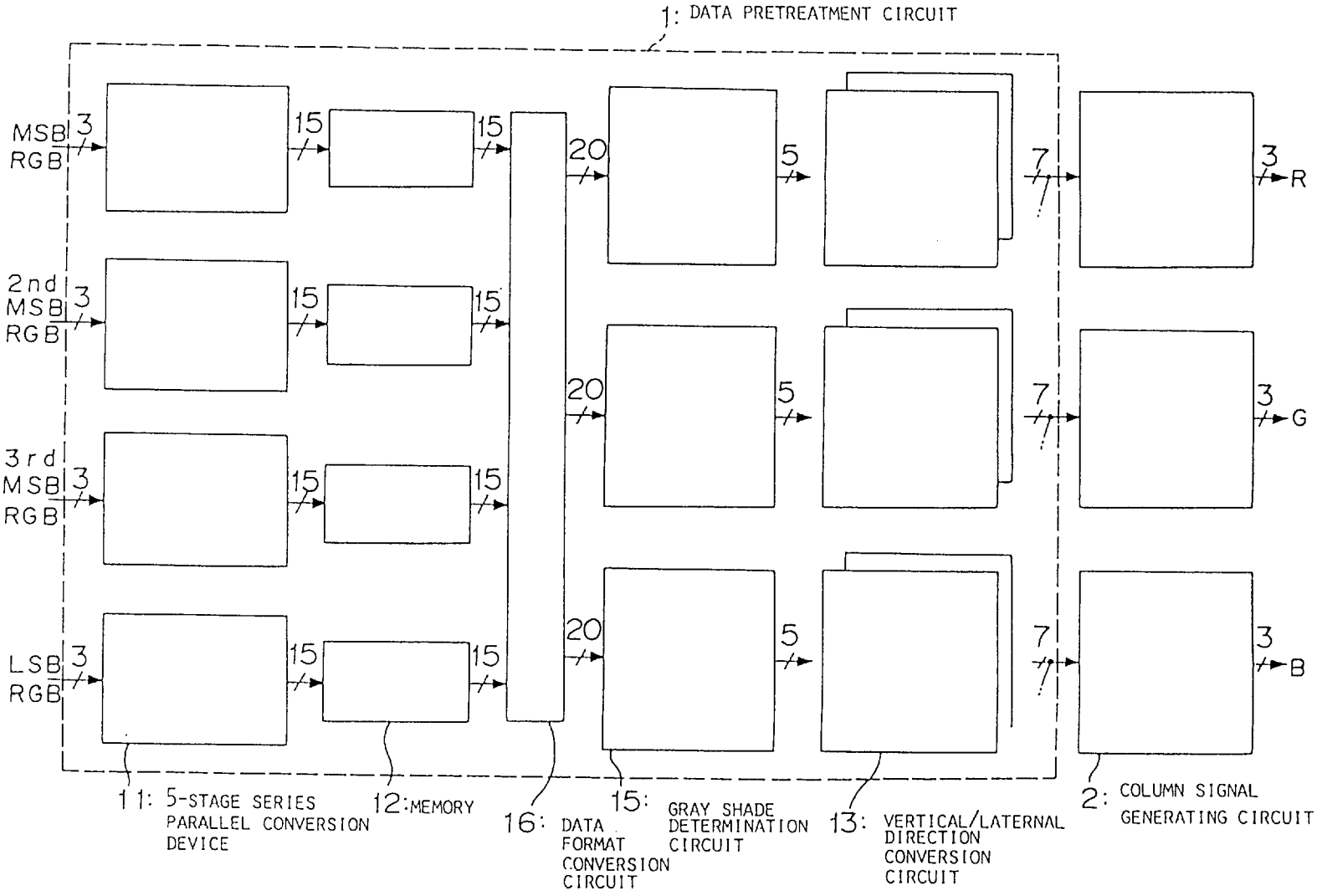
FIG. 10 is a block diagram showing a data pretreatment circuit 1.

The data pretreatment circuit 1 is constituted as shown in FIG. 10. Signals are treated by dividing 4-bit picture data having a gray shade information into four groups each having 3 bits for R, G and B. Namely, the signals are divided into four groups of MSB($2^3$), 2nd MSB($2^2$), 3rd MSB($2^1$) and LSB($2^0$) in order to treat them in parallel.

The 3-bit data are inputted to 5-stage series/parallel converters 11 where the data are converted into 15-bit data, and the data are fed to memories 12. Specifically, serial data are inputted to the input terminals of 5-stage shift registers, and the tap output of the registers are inputted to each of the memories 12.

As the memories 12, VRAMs having a data width of 16 bits are used. Addressing operation to the memories 12 are conducted with use of direct access mode as follows. Namely, the data on the row electrodes corresponding to the same column electrodes are stored in adjacent 7 addresses with respect to 7 row electrodes which are simultaneously selected, whereby the reading-out operations from the memories at the late stage can be conducted at a high speed, and calculations can be simplified.

The reading-out of the data from the memories 12 is conducted at a timing of driving the LSB by a rapid successive access mode so that four sets of 15-bit data are fed to a data format conversion circuit 16. In a case of making the imaginary data in correspondence with the data on the row electrodes in the vicinity of the imaginary electrode, the reading-out of the data is repeated several times at the position corresponding to the imaginary row electrode.

The data format conversion circuit 16 is adapted to re-arrange the 15-bit data supplied for each gray shade in parallel into parallel signals having a 20-bit width for R, G, B. The circuit performing such function can be obtained by wiring suitably on a circuit substrate.

Data which have been converted into three sets of 20 bit data for R, G and B in the data format conversion circuit 16, are supplied to gray shade determination circuits 15. Each of the gray shade determination circuits 15 is a frame modulation circuit which converts gray shade data of 4-bits per dot into 1-bit data of ON/OFF to use them as video signals for a subpicture surface, and realizes a gray shade display for the subpicture surface in, for example, 15 cycles.

Specifically, a multiplexer which distributes the data of a 20 bit length to date of a 5 bit length at a predetermined timing, is used. The relation of correspondence of bits to the subpicture surfaces is determined via a count number by a frame counter. Thus, the 20-bit data corresponding to the gray shade data for 5 dots are converted into serial data without gray shade of 5 bits to be outputted to vertical/lateral direction conversion circuits 13.

Each of the vertical/lateral conversion circuits 13 is a circuit for storing the display data for 5 pixels by transferring 7 times, and for reading-out the display data as data for 7 pixels which are read out 5 times. The vertical/lateral conversion circuit 13 is constituted by two sets of 5×7 bit registers. The data signals of the vertical/lateral conversion circuit 13 are transferred to the column signal generating circuits 2.

Figure 11:
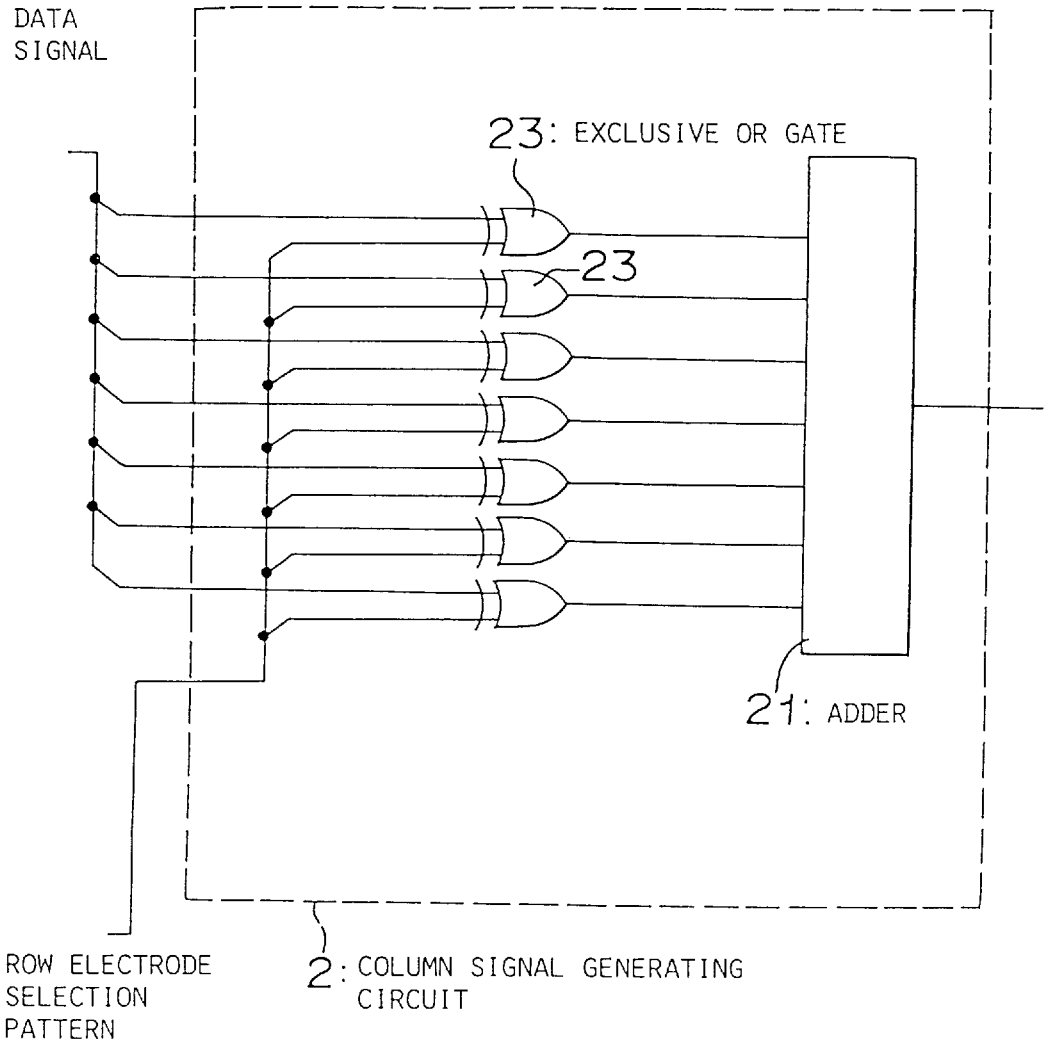
FIG. 11 is a block diagram showing a column signal generating circuit 2.

FIG. 11 shows the construction of the column signal generating circuit 2. 7 bit data signals are inputted to each exclusive OR gate 23. Each of the exclusive OR gates 23 also receives signals from the orthogonal function generating circuit 5. Output signals from the exclusive OR gates 23 are supplied to an adder 21 in which a summing operation is conducted for the data on simultaneously selected row electrodes.

Figure 12:
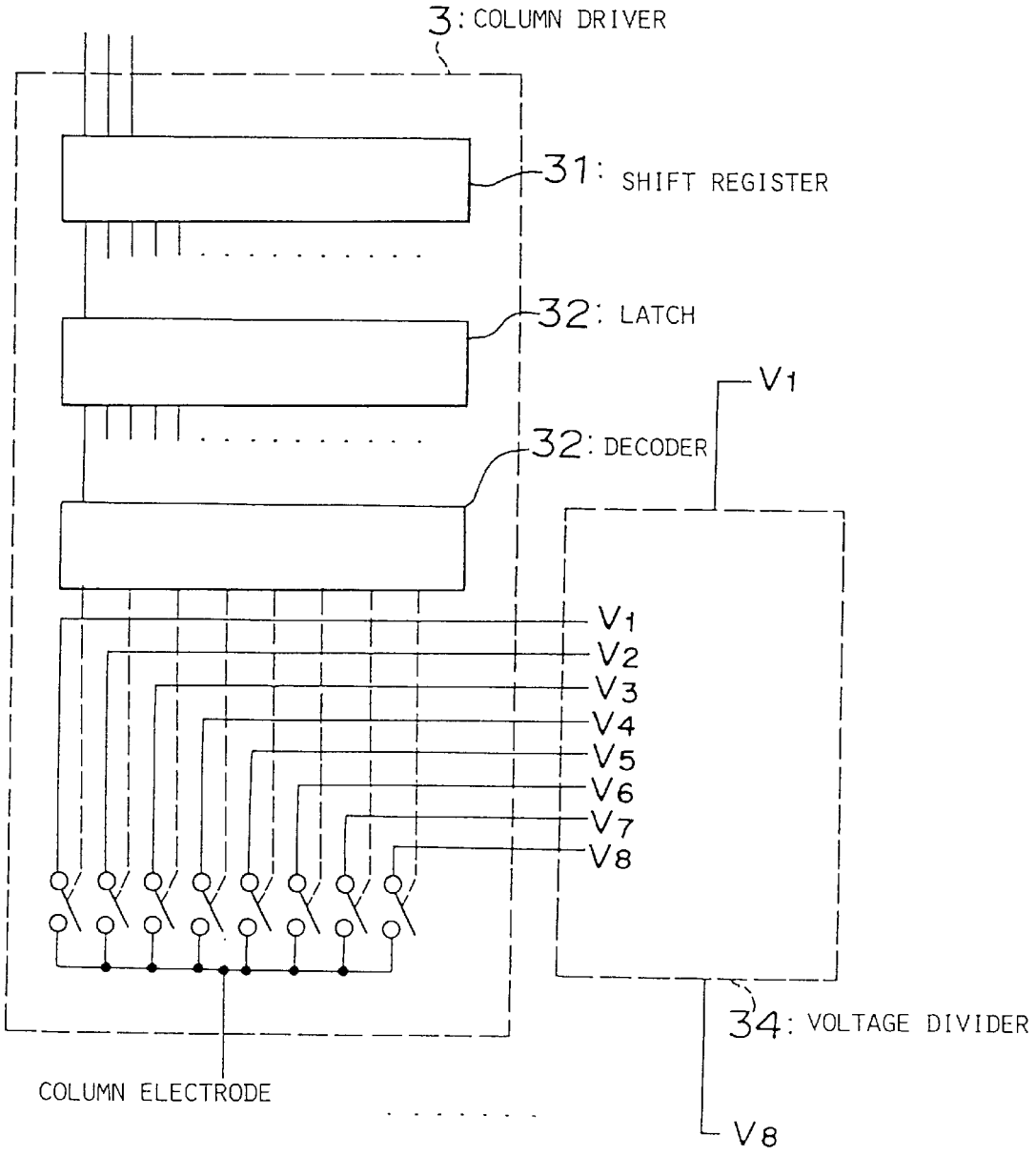
FIG. 12 is a block diagram showing a column driver 3.

The column drivers have such a construction as shown in FIG. 12, wherein each comprises a shift register 21, a latch 32, a decoder 33 and a voltage divider 34. A demultiplexer is used for a voltage level selection device 33. When the data on a line is supplied to the shift register 21, the conversion of the display data into column voltages is performed.

Figure 13:
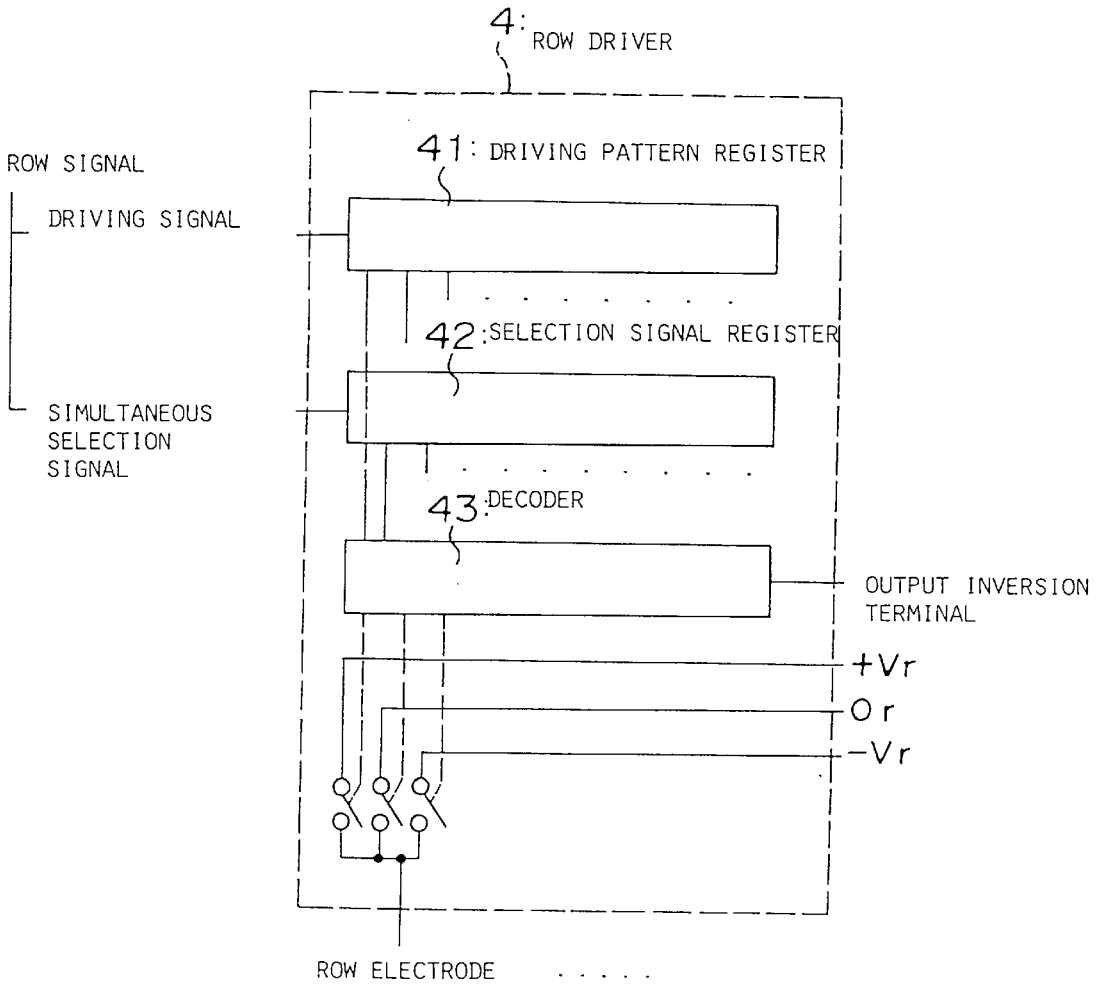
FIG. 13 is a block diagram showing a row driver 4.

The row driver 4 has a construction shown in FIG. 13. It comprises a driving pattern register 41, a selection signal register 42 and a decoder 43. Row electrodes to be simultaneously selected are determined depending on data of the selection signal register 42, and the polarity of the selection signals to be supplied to the selected row electrodes is determined depending on the data of the driving pattern register 41. A voltage of zero(0) volts is outputted to non-selection row electrodes.

FIGS. 9 through 13 merely show examples of possible circuits. It is therefore noted that other constructions of these circuits can be used according to the present invention as will be apparent to those skilled in the art.

EXAMPLES

Example 1

Each liquid crystal display panel was driven under the following conditions with use of the circuit shown in FIGS. 9 through 13. The liquid crystal display panel had a VGA module of 9.4 inches (the number of pixels: 480×240×3 (RGB)) and a back light at the back surface. The response time of the liquid crystal display panel by taking the rising time and the falling time was 60 ms on average. The panel was driven by simultaneously selecting 7 row electrodes for each subgroup and advancing a column of selection matrix by one (method 1). The picture surface was divided into two picture surfaces in the vertical direction, whereby the number of the subgroups was 35. The adjustment of the bias was conducted so that the contrast ratio became substantially the maximum. The contrast ratio of display was 30:1 and the maximum brightness was 100 cd/$m^2$.

As the selection matrix, the orthogonal matrix of 7 rows and 8 columns having orthogonal row vectors as shown in FIG. 7 was used. The column vectors were designated as $A_1$, $A_2$, . . . , $A_8$, and the liquid crystal display panel was driven by using the sequence shown in FIG. 1*a*. A picture of 16 gray shades was displayed under a frame rate control using 4 display cycles in addition to a dithering method. The polarities of the selection pulses were inverted every 40 times so that the voltages applied to the liquid crystal were formed into an alternating current form.

A display having little crosstalk was obtained and flicker did not occur either in a binary display or an intermediate display.

Example 2

The liquid crystal display device was driven in the same manner as in Example 1 wherein the sequence of the selection pulses was in accordance with FIG. 2*a*. A display in which crosstalk was suppressed was obtained, however, some flickering was found in a binary display. Further, the flickering was increased in a gray shade display whereby the quality of display decreased.

Examples 3 and 4

The liquid crystal display devices were driven in substantially the same manner as Example 1 wherein the sequence of the selection pulses was in accordance with FIG. 3*a* (Example 3) and FIG. 4*a* (Example 4). In Example 3, the crosstalk was suppressed in a flat pattern, and the level of flicker was substantially the same as Example 1. In Example 4, the dispersion of pulses was reduced. Accordingly, the contrast ratio was reduced about 10% in comparison with Example 1, and the crosstalk was slightly increased. The flicker level was substantially the same as Example 1.

Examples 5 to 14

The same liquid crystal display panels as in Example 1 were driven in the following conditions with use of the circuit shown in FIGS. 9 through 13. The liquid crystal display panels were driven by simultaneously selecting 7 row electrodes for each subgroup and advancing a column of the selection matrix by one (method 1). The picture surface was divided into two picture surfaces in the vertical direction whereby the number of the subgroups was 35. The adjustment of the bias was conducted so that the contrast ratio became substantially the maximum. The contrast ratio of display was 30:1 and the maximum brightness was 100 cd/m$^2$.

The selection matrix of 3 rows and 4 columns shown in FIG. 17*a* was used, and the liquid crystal display panels were driven by selecting simultaneously an L=3 number of row electrodes. In FIG. 17*a*, 3 lines in an Hadamard's matrix of 4×4 are used and a time period is formed with 2 display cycles. The series of selection pulses was formed by using first the selection matrix (A), and subsequently, the matrix formed by inverting the signs of the matrix (A). The row voltage sequence vectors which show a sequence of the positive and negative signs of row voltages (selection pulse voltages) are shown in FIG. 17*a*. In the first and third lines, the number of times of the change of the signs is $R_i$=6, and the maximum element is $Z_{o,j}$=2. In the second line, $R_i$=2 and $Z_{o,j}$=4. A display of entirely ON was made in accordance with the driving method as described above. As a result, the line corresponding to the second line was bright, and the uniformity in the entire display was damaged.

In the following, there are shown examples in which matrices having different size as shown in FIGS. 14, 17, 18 and 19 were used. In Table 2, there are shown three conditions as follows:

Condition (1): the maximum difference between lines of the number of times of the inversion of the positive and negative signs of the row voltages $|R_i-R_j|/R_{max}$, Condition (2): the maximum ratio between lines of the longest time period of the row voltages $Z_{o,j}/Z_{max}$, and Condition (3): the relation of the maximum displacement of the column voltages (where Y: the satisfaction of $\Delta y_i<0.7\cdot L$, and N: the dissatisfaction of the formula). In Table 2, characters A, B and C indicate good, normal and no good, respectively.

The liquid crystal display panel was driven under the driving condition shown in FIG. 19*c* wherein the polarities of the row selection voltages and the column voltages were inverted every time of selecting 32 subgroups. As a result, a very uniform display in which a crosstalk and the unevenness between lines in picture images were negligible could be obtained.

TABLE 2

| | | (1) | (2) | (3) | Unevenness between lines | Crosstalk | Pattern dependence |
|---|---|---|---|---|---|---|---|
| Example 5 | Figure 14 | 0 | 3/4 | Y | A | A | A |
| Example 6 | Figure 17(a) | 4/6 | 2/4 | N | C | C | C |
| Example 7 | Figure 17(b) | 2/4 | 1/2 | N | C | C | C |
| Example 8 | Figure 17(c) | 0 | 3/4 | N | A | B | B |
| Example 9 | Figure 17(d) | 0 | 1 | Y | A | A | B |
| Example 10 | Figure 18(a) | 4/6 | 2/4 | N | C | C | C |
| Example 11 | Figure 18(b) | 0 | 3/5 | N | B | C | B |
| Example 12 | Figure 19(a) | 4/10 | 3/6 | Y | C | A | B |
| Example 13 | Figure 19(b) | 1/8 | 4/6 | Y | B | A | A |
| Example 14 | Figure 19(c) | 0 | 3/5 | Y | A | A | A |

INDUSTRIAL APPLICABILITY

According to the present invention, the increment of frequency components, which is caused by driving a picture display device with use of a multiple line selection method, can be prevented. In particular, occurrence of a conspicuous flicker, which is caused in a gray shade display under a frame rate control, can be suppressed.

Further, the frequency components can be easily controlled by suitably carrying out the polarity inversion of driving signals. In particular, the polarity inversion can be conducted with a time period of integral times of a unit of repetition. Further, in the present invention, since the time period of the unit of repetition is short, the degree of freedom in the determination of the timing of polarity inversion becomes large, with the result that the degree of freedom in controlling the frequency components is increased.

According to an embodiment of the present invention, when the picture display device is driven by a multiple line selection method wherein at least two different selection matrices are used, the vector lengths $R_i$ and $R_j$ of row voltage sequence vectors $(Z)_i$ and $(Z)_j$ (i and j indicate i rows and j rows respectively) and the maximum value $R_{max}$ of $R_i$ (i=1~L) satisfy a relation of $|R_i-R_j|/R_{max}\leqq 0.3$ (i, j=1~L). Accordingly, an uneven display due to unevenness between the lines and dependence to the display pattern can be controlled, and a display having a high quality can be obtained. Further, there is no risk of the reduction of the frequency components.

Further, the maximum value $Z_{o,j}$ of the elements of $(Z)_j$ and the maximum value $Z_{max}$ of $Z_{o,j}$ (j=1~L) substantially satisfy a relation $0.6 \leqq Z_{o,j}/Z_{max} \leqq 1$ (j=1~L). Accordingly, unevenness between the lines can be further controlled and a display having a high quality can be obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of driving a picture display device having a plurality of row electrodes and a plurality of column electrodes, by selecting simultaneously a plurality of row electrodes, the driving method including the steps of:

applying, dispersively, selection pulse vectors to the simultaneously selected row electrodes in a time period in which addressing operations are finished, and forming a sequence obtained by arranging, time-sequentially, the selection pulse vectors applied to the simultaneously selected row electrodes by repeating a subsequence, as a unit, having a time period of 1/n (where n is an integer ≧2) times the time period in which the addressing operations are finished.

2. The method of driving a picture display device according to claim 1, wherein each value of m'=m/p and s'=s/p is an integer, and a remainder obtained by dividing m' by s' is an odd number, where s is a length of the subsequence in which an application of selection pulses is used as a unit, m is a number of groups of the simultaneously selected row electrodes, and p is a number of times a same selection pulse vector is continuously used.

3. The method of driving a picture display device according to claim 2, wherein a value of K·m' is a multiple of s, where K is a number of kinds of selection pulse vectors.

4. The method of driving a picture display device according to claim 1, wherein a value of s"=s/g is an integer, and a remainder obtained by dividing m by s" is an odd number, where s is a length of the subsequence in which an application of selection pulses are used as a unit, m is a number of groups of the simultaneously selected row electrodes, and g is a number of times the selection pulse vectors are continuously applied to a specified group of simultaneously selected row electrodes.

5. The method of driving a picture display device according to claim 1, wherein an imaginary group of simultaneously selected row electrodes is provided for driving.

6. The method of driving a picture display device according to claim 1, wherein row signals and column signals are inverted before a display cycle is finished.

7. The method of driving a picture display device according to claim 6, wherein when (x)=(1, 1, . . . , 1), column electrode voltages $y_{j-1}$ and $y_j$ before and after the polarity inversion, respectively, satisfy $|y_j| \leqq 0.5 \cdot L$ (where j−1 and j are subscripts indicating a time just before and just after the polarity inversion, respectively), where L indicates a number of simultaneously selected row electrodes.

8. A method of driving a picture display device having a plurality of row electrodes and a plurality of column electrodes, by selecting a number L (where L≧3) of row electrodes simultaneously and by applying to the row electrodes selection pulses based on column vectors in an orthogonal selection matrix A having row vectors of L rows and K columns arranged orthogonally, the driving method the driving method including the steps of:

using at least two different selection matrixes ($A_1$, $A_2$, . . . , $A_x$), and forming an orthogonal matrix (B)=$A_1$, $A_2$, . . . , $A_x$) of L rows and (K·X) columns by continuously arranging the at least two different selection matrices in an order of use, wherein a relation of $|R_i - R_j| R_{max} \leqq 0.3$(i, j=1~L) is substantially satisfied, where $R_i$ and $R_j$ indicate respectively a length of row voltage sequence vectors $(Z)_i$, $(Z)_j$ (i and j represent i rows and j rows in the matrix (B) respectively) which have as elements a length of continuing positive or negative signs of row vectors in the matrix (B), and $R_{max}$ indicates the maximum value of $R_i$ (i=1~L).

9. The method of driving a picture display device according to claim 8, wherein the maximum value $Z_{o,j}$ of the elements of $(Z)_j$ and the maximum value $Z_{max}$ of $Z_{o,j}$ (j=1~L) substantially satisfies a relation of $0.6 \leqq Z_{o,j}/Z_{max} \leqq 1$ (j=1~L).

10. The method of driving a picture display device according to claim 8, wherein column electrode display pattern vectors (x)=($x_1$, $x_2$, . . . , $x_M$) having, as elements, display patterns (1:OFF and −1:ON) corresponding to row electrodes simultaneously selected on specified column electrodes and column electrode voltage sequence vectors (y)=($y_1$, $Y_2$, . . . , $y_N$) having, as elements, voltages levels applicable to the column electrodes, the voltage levels being composed of an N number of voltage pulses, arranged time -sequentially in a display cycle have a relation:

($y_1$, $y_2$, . . . , $y_N$)=($x_1$, $x_2$, . . . , $x_M$) (S) and, when (x)=(1, 1, . . . , 1), $\Delta y_i < 0.7 \cdot L$, where $\Delta y_i = |y_i - y_{i-1}|$(i=2 to N).

11. The method of driving a picture display device according to claim 8, wherein column electrode display pattern vectors (x) ($x_{1,\ x2}$, . . . , $x_M$) having, as elements, display patterns (1:OFF and −1:ON) corresponding to row electrodes simultaneously selected on a specified column electrode and column electrode voltage sequence vectors (y)=($y_1$, $y_2$, . . . , $y_N$) having, as elements, voltages levels applicable to the column electrode, the voltage levels being composed of an N number of voltage pulses, arranged time-sequentially in a display cycle have a relation:

($y_1$, $y_2$, . . . , $y_N$)=($x_1$, $x_2$, . . . , $x_M$) (s) and, when (x)=(1, 1, . . . , 1), $\Delta y_i \leqq 0.7 \cdot L$, where $\Delta y_i = |y_i - y_{i-1}|$(i=2 to N).

* * * * *